US009388807B2

(12) United States Patent
Sekiya et al.

(10) Patent No.: US 9,388,807 B2
(45) Date of Patent: Jul. 12, 2016

(54) VANE COMPRESSOR HAVING A SECOND DISCHARGE PORT THAT INCLUDES AN OPENING PORTION TO A COMPRESSION SPACE

(71) Applicants: Shin Sekiya, Chiyoda-ku (JP); Raito Kawamura, Chiyoda-ku (JP); Hideaki Maeyama, Chiyoda-ku (JP); Shinichi Takahashi, Chiyoda-ku (JP); Tatsuya Sasaki, Chiyoda-ku (JP); Kanichiro Sugiura, Chiyoda-ku (JP)

(72) Inventors: Shin Sekiya, Chiyoda-ku (JP); Raito Kawamura, Chiyoda-ku (JP); Hideaki Maeyama, Chiyoda-ku (JP); Shinichi Takahashi, Chiyoda-ku (JP); Tatsuya Sasaki, Chiyoda-ku (JP); Kanichiro Sugiura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 135 days.

(21) Appl. No.: 14/350,989

(22) PCT Filed: Dec. 12, 2012

(86) PCT No.: PCT/JP2012/082143

§ 371 (c)(1),
(2) Date: Apr. 10, 2014

(87) PCT Pub. No.: WO2013/105386

PCT Pub. Date: Jul. 18, 2013

(65) Prior Publication Data

US 2014/0286807 A1 Sep. 25, 2014

(30) Foreign Application Priority Data

Jan. 11, 2012 (JP) ..... 2012-003257

(51) Int. Cl.
*F03C 2/00* (2006.01)
*F03C 4/00* (2006.01)
(Continued)

(52) U.S. Cl.
CPC ..... *F04C 18/02* (2013.01); *F01C 21/0863* (2013.01); *F04C 18/321* (2013.01);
(Continued)

(58) Field of Classification Search
CPC ..... F04C 2/344; F04C 2/3446; F04C 18/321; F04C 18/344; F04C 18/3441; F04C 18/352; F04C 29/02; F04C 29/023; F04C 29/025; F04C 29/12; F04C 2240/63; F04C 2240/809; F04C 2240/603
USPC ..... 418/82, 88, 93, 94, 136–137, 145, 148, 418/241, 259
See application file for complete search history.

(56) References Cited

U.S. PATENT DOCUMENTS 1,291,618 A 1/1919 Olson
1,339,723 A 5/1920 Smith
(Continued)

FOREIGN PATENT DOCUMENTS

CH 181039 A 11/1935
DE 874 944 C 4/1953
(Continued)

OTHER PUBLICATIONS

International Search Report Issued Feb. 12, 2013 in PCT/JP12/082143 Filed Dec. 12, 2012.
(Continued)

*Primary Examiner* — Theresa Trieu
(74) *Attorney, Agent, or Firm* — Oblon, McClelland, Maier & Neustadt, L.L.P

(57) ABSTRACT

A vane compressor includes a cylinder, a rotor portion, vanes, and a first discharge port allowing a refrigerant in a compression chamber to be discharged therethrough. The vanes are disposed inside the rotor portion and held rotatably about the center of a cylinder inner circumferential surface, partition a space between the cylinder inner circumferential surface and the rotor portion, and form the compression chamber. A second discharge port is disposed at a location having a phase angle smaller than that at the first discharge port, being open to the cylinder inner circumferential surface, and communicating with the compression chamber. The second discharge port includes an opening portion to the compression chamber, the opening portion having a width in the circumferential direction, the width being equal to or smaller than the width of the tip of each of the vanes.

9 Claims, 18 Drawing Sheets

(51) Int. Cl.

| | |
|---|---|
| ***F04C 2/00*** | (2006.01) |
| ***F04C 18/02*** | (2006.01) |
| ***F04C 29/02*** | (2006.01) |
| ***F04C 29/12*** | (2006.01) |
| ***F04C 18/32*** | (2006.01) |
| ***F04C 18/352*** | (2006.01) |
| *F01C 21/08* | (2006.01) |
| *F04C 23/00* | (2006.01) |
| *F04C 28/28* | (2006.01) |

(52) U.S. Cl.

CPC ..... *F04C18/352* (2013.01); *F04C 29/025* (2013.01); *F04C 29/028* (2013.01); *F04C 29/128* (2013.01); *F01C 21/0836* (2013.01); *F04C 23/008* (2013.01); *F04C 28/28* (2013.01)

(56) References Cited

U.S. PATENT DOCUMENTS

| | | | |
|---|---|---|---|
| 1,444,269 | A | 2/1923 | Piatt |
| 2,044,873 | A | 6/1936 | Beust |
| 4,408,968 | A | 10/1983 | Inagaki et al. |
| 4,955,985 | A | 9/1990 | Sakamaki et al. |
| 4,958,995 | A | 9/1990 | Sakamaki et al. |
| 4,997,351 | A | 3/1991 | Sakamaki et al. |
| 4,997,353 | A | 3/1991 | Sakamaki et al. |
| 4,998,867 | A | 3/1991 | Sakamaki et al. |
| 4,998,868 | A | 3/1991 | Sakamaki et al. |
| 5,002,473 | A | 3/1991 | Sakamaki et al. |
| 5,011,390 | A | 4/1991 | Sakamaki et al. |
| 5,022,842 | A | 6/1991 | Sakamari et al. |
| 5,030,074 | A | 7/1991 | Sakamaki et al. |
| 5,032,070 | A | 7/1991 | Sakamaki et al. |
| 5,033,946 | A | 7/1991 | Sakamaki et al. |
| 5,044,910 | A | 9/1991 | Sakamaki et al. |
| 5,087,183 | A | 2/1992 | Edwards |
| 5,536,153 | A | 7/1996 | Edwards |
| 6,193,906 | B1 | 2/2001 | Kaneko et al. |
| 6,223,554 | B1 | 5/2001 | Adachi |
| 8,602,760 | B2 | 12/2013 | Maeyama et al. |

FOREIGN PATENT DOCUMENTS

| | | | | |
|---|---|---|---|---|
| GB | 26718 | A | | 0/1910 |
| GB | 244181 | A | | 12/1925 |
| JP | 49-132607 | A | | 12/1974 |
| JP | 51-128704 | A | | 11/1976 |
| JP | 52-60911 | A | | 5/1977 |
| JP | 56-29001 | A | | 3/1981 |
| JP | 56 90490 | | | 7/1981 |
| JP | 56 150886 | | | 11/1981 |
| JP | 58 70087 | | | 4/1983 |
| JP | 58 67996 | | | 5/1983 |
| JP | 60-1389 | A | | 1/1985 |
| JP | 61 132793 | | | 6/1986 |
| JP | 63 73593 | | | 5/1988 |
| JP | 63-73593 | U | | 5/1988 |
| JP | 63-131883 | A | | 6/1988 |
| JP | 5-133367 | A | | 5/1993 |
| JP | 6 501758 | | | 2/1994 |
| JP | 6-501758 | A | | 2/1994 |
| JP | 8-247063 | A | | 9/1996 |
| JP | 8-247064 | A | | 9/1996 |
| JP | 2000 352390 | | | 12/2000 |
| JP | 2007 309281 | | | 11/2007 |
| JP | 2008 14227 | | | 1/2008 |
| JP | 2009264175 | A | * | 11/2009 ..... F04C 18/321 |
| WO | WO 96/00852 | A1 | | 1/1996 |
| WO | WO 2010/150816 | A1 | | 12/2010 |

OTHER PUBLICATIONS

International Search Report and Written Opinion issued Jul. 2, 2013 in PCT/JP2013/059582 (with English translation of categories of cited documents).

Office Action issued Oct. 29, 2013 in Japanese Patent Application No. 2012-529553 (with English language translation).

Extended European Search Report issued Jun. 17, 2014 in Patent Application No. 11818068.6.

Extended European Search Report issued Jun. 17, 2014 in Patent Application No. 11818070.2.

Office Action mailed Aug. 14, 2014 in co-pending U.S. Appl. No. 13/700,634.

Office Action issued Sep. 30, 2014 in Japanese Patent Application No. 2012-002807 (with English language translation).

Office Action issued Sep. 30, 2014 in Japanese Patent Application No. 2012-003556 (with English language translation).

U.S. Appl. No. 14/350,998, filed Apr. 10, 2014, Sekiya, et al.

U.S. Appl. No. 14/350,937, filed Apr. 10, 2014, Sekiya, et al.

U.S. Appl. No. 14/350,959, filed Apr. 10, 2014, Sekiya, et al.

Office Action issued on Nov. 11, 2014 in Japanese Patent Application No. 2013-553219 with English translation.

Extended European Search Report issued on Aug. 14, 2015 in European Patent Application No. 12865289.8.

Combined Chinese Office Action and Search Report issued Sep. 17, 2015 in Patent Application No. 201280055578.6 (with partial English language translation and English translation of categories of cited documents).

* cited by examiner (a)

(b)

C: VANE LONGITUDINAL DIRECTION OF VANE 5a, 6a
D: LINE NORMAL TO ARC OF VANE TIP 5b, 6b

VANE COMPRESSOR HAVING A SECOND DISCHARGE PORT THAT INCLUDES AN OPENING PORTION TO A COMPRESSION SPACE

TECHNICAL FIELD

The present invention relates to a vane compressor.

BACKGROUND ART

There has been proposed a typical vane compressor described below (see, for example, Patent Literature 1). The vane compressor includes a rotor shaft (an integrated unit of a cylindrical rotor portion that rotates in a cylinder and a shaft that transmits a rotational force to the rotor portion), and a vane received in each of one or more vane grooves in the rotor portion. The vane slides while its tip is in contact with the inner circumferential surface of the cylinder. The cylinder includes a discharge port extending in a radial direction and disposed in its inner circumferential surface at a location that is near the finish of the discharge stroke and that has a large phase angle.

There has also been proposed a vane compressor including an auxiliary discharge port to reduce the loss caused by excessive compression of discharge gas remaining in a narrow space after passing through a discharge port (see, for example, Patent Literature 2). The auxiliary discharge port extends in a radial direction and disposed in the inner surface of the cylinder at a location having a phase angle larger than that at the above-described discharge port (hereinafter referred to as first discharge port) (that is, at a location downstream of the first discharge port in the direction of rotation of the vane and downstream in the compression stroke), the location being near the first discharge port.

CITATION LIST

Patent Literature

Patent Literature 1: Japanese Unexamined Patent Application Publication No. 2007-309281 (Paragraph [0020], FIG. 1)

Patent Literature 2: Japanese Unexamined Patent Application Publication No. 2008-014227 (Abstract, FIG. 3)

SUMMARY OF INVENTION

Technical Problem

The vane compressor illustrated in Patent Literature 1 includes the discharge port near the finish of the discharge stroke. However, because the cross-sectional area of the compression chamber in the flow direction (hereinafter referred to as flow area) is small in the vicinity of the finish of the discharge stroke, that vane compressor suffers from an increased pressure loss caused by an increase in the flow velocity of the refrigerant before it flows into the discharge port.

The vane compressor illustrated in Patent Literature 2 includes two discharge ports. However, because the auxiliary discharge port is simply disposed at the location having a phase angle larger than that at the first discharge port, it is impossible to have a large flow area in the first discharge port location. Thus, the flow velocity of the refrigerant before it flows into the first discharge port in the vane compressor illustrated in Patent Literature 2 also cannot be reduced, and that vane compressor suffers from an increased pressure loss.

The present invention is made to solve the above-described problems. It is an object of the invention to provide an efficient vane compressor capable of reducing the pressure loss in a discharge stroke.

Solution to Problem

A vane compressor according to the present invention includes a cylinder, a cylinder head, a frame, a cylindrical rotor portion, a rotating shaft portion, a vane, and a first discharge port. The cylinder includes a cylindrical inner circumferential surface that defines a hole having opposite openings. The cylinder head covers one of the openings. The frame covers another one of the openings. The rotor portion is configured to rotate about a rotation axis displaced from a central axis of the inner circumferential surface inside the cylinder. The rotating shaft portion is configured to transmit a rotational force to the rotor portion. The vane is disposed inside the rotor portion, held rotatably about a center of the cylinder inner circumferential surface of the cylinder, and partitions a compression space formed between the cylinder and the rotor portion into at least a suction space and a discharge space. The first discharge port communicates with the compression space and allows gas compressed in the compression space to be discharged therethrough. A second discharge port communicating with the compression space is provided at a location upstream from the first discharge port in a compression stroke. The second discharge port includes an opening portion to the compression space, the opening portion having a width equal to or smaller than a width of the vane.

Advantageous Effects of Invention

In the vane compressor according to the present invention, the second discharge port is disposed at the location having a phase angle smaller than that at the first discharge port, the flow area at the location of the second discharge port can be large, and thus the flow velocity of gas before it flows into the second discharge port can be low. Accordingly, the pressure loss can be reduced. In the vane compressor according to the present invention, because the width of the second discharge port in the circumferential direction is equal to or smaller than the width of the tip of the vane, even when the vane passes by the second discharge port, leakage of gas from the high-pressure side compression space to the low-pressure side compression space can be maintained small. According to the present invention, the pressure loss in the discharge stroke can be reduced without an increase in the leakage loss from the high-pressure side compression space to the low-pressure side compression space. Accordingly, the efficient vane compressor can be provided.

DESCRIPTION OF EMBODIMENTS

Examples of a vane compressor according to the present invention are described below in the following embodiments.

Embodiment 1

Figure 1:
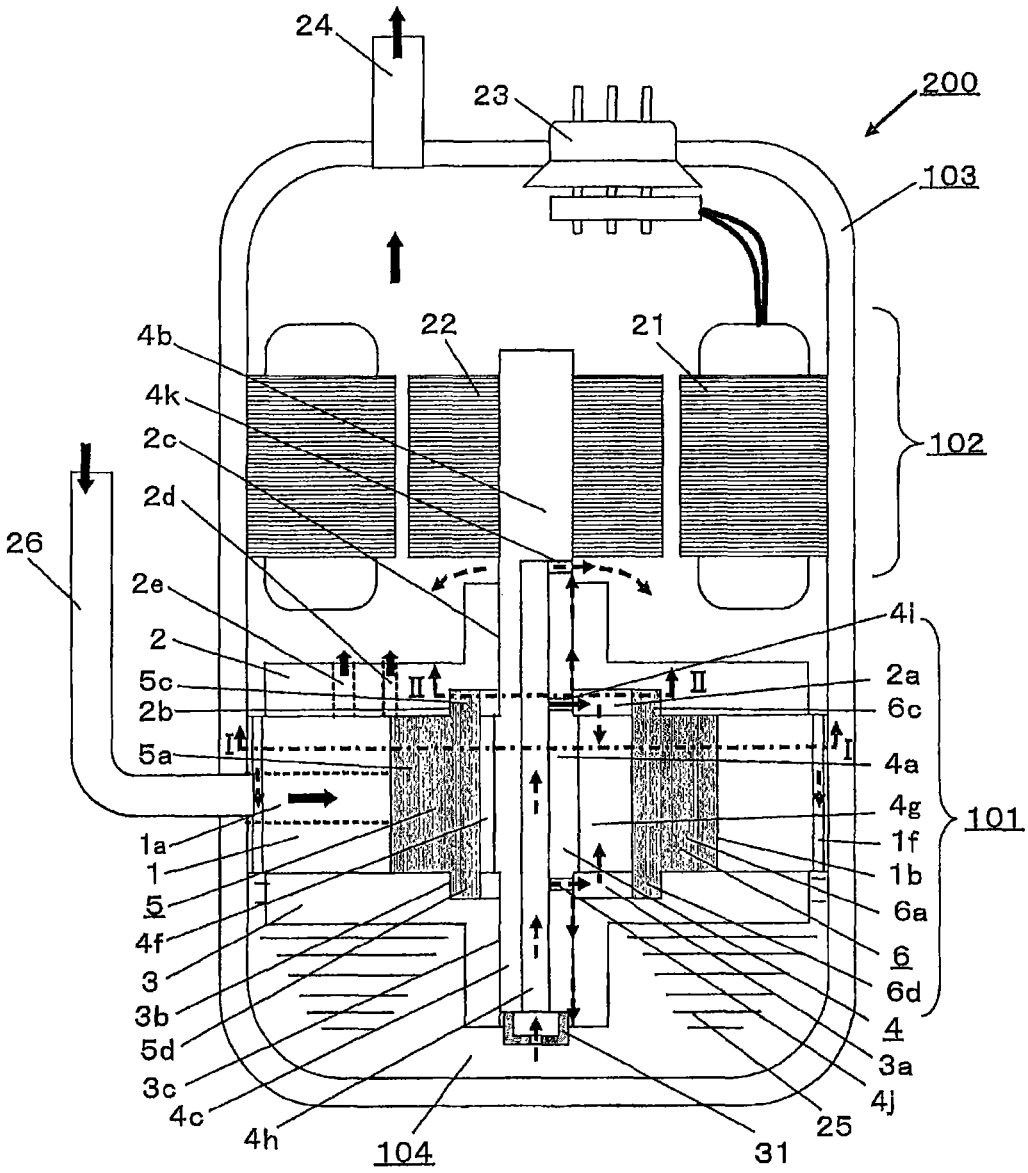
FIG. 1 is a longitudinal sectional view that illustrates a vane compressor according to Embodiment 1 of the present invention.
Figure 2:
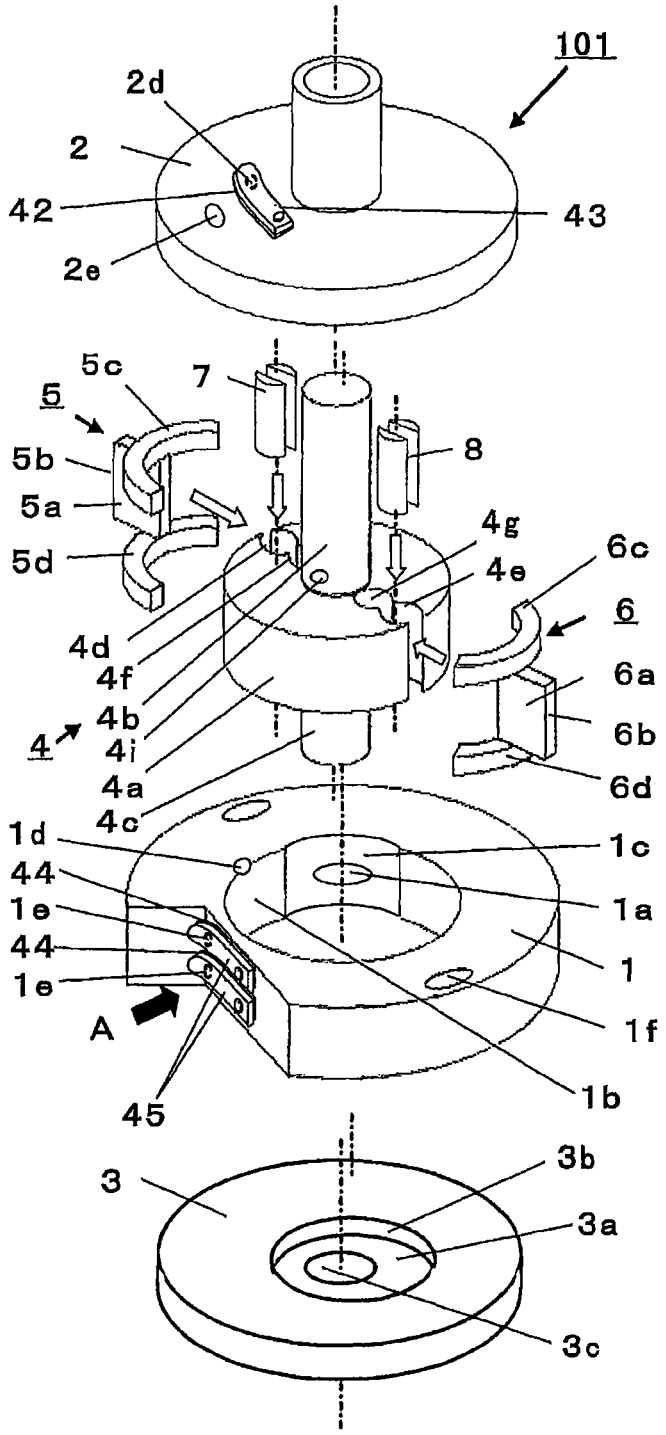
FIG. 2 is an exploded perspective view that illustrates a compressing element in the vane compressor according to Embodiment 1 of the present invention.
Figure 3:
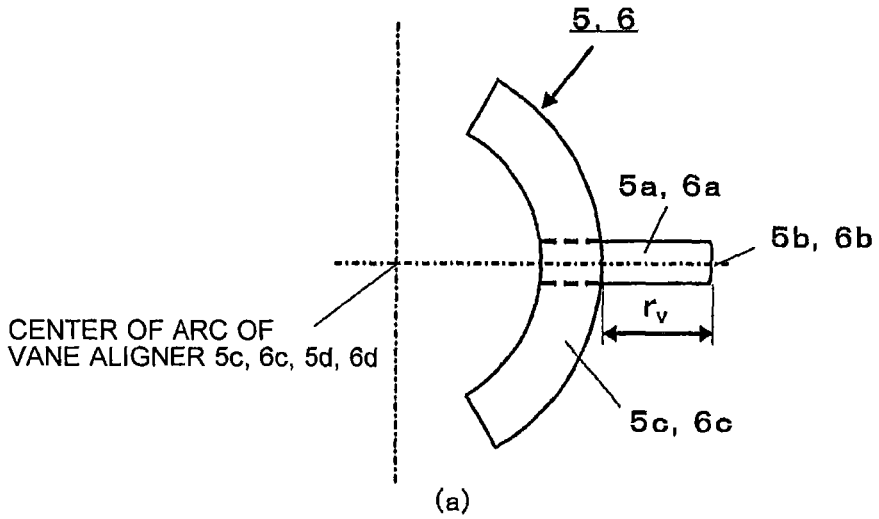
FIG. 3(*a*) and FIG. 3(*b*) include illustrations of a vane in the compressing element according to Embodiment 1 of the present invention.
Figure 3:
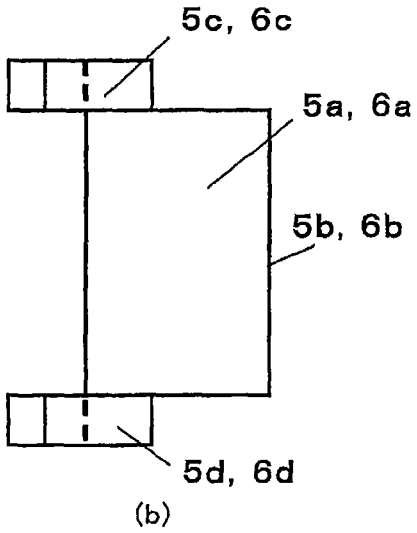
Figure 4:
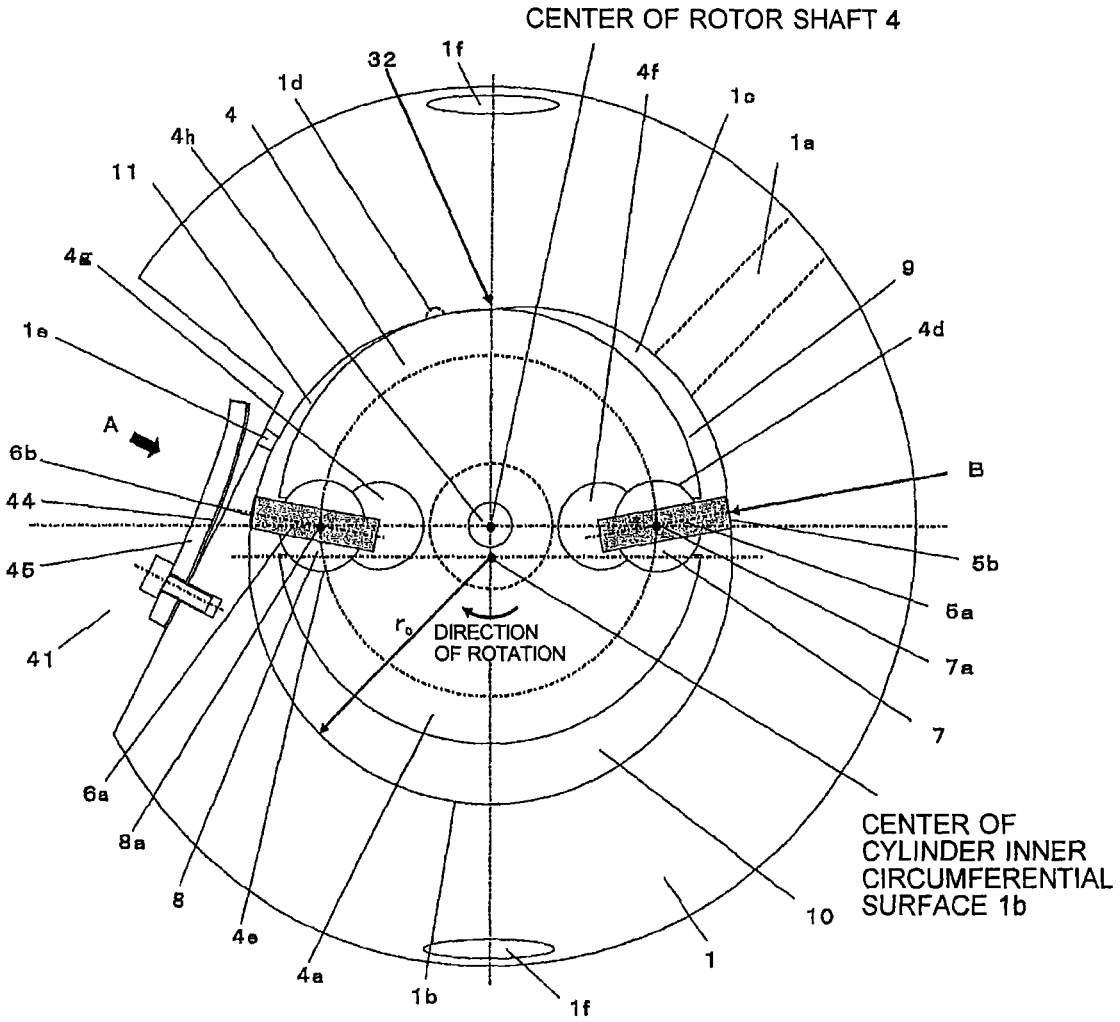
FIG. 4 is a cross-sectional view taken along the line I-I in FIG. 1.
Figure 5:
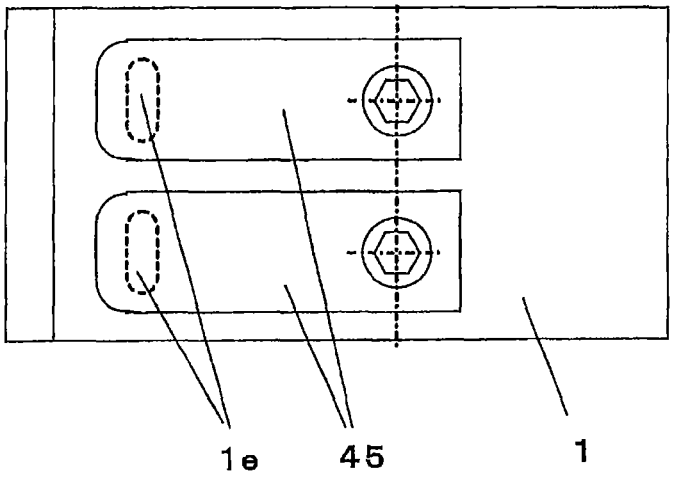
FIG. 5 is a view seen from the arrow A in FIGS. 2 and 4.

FIG. 1 is a longitudinal sectional view that illustrates a vane compressor according to Embodiment 1 of the present invention. FIG. 2 is an exploded perspective view that illustrates a compressing element in the vane compressor. FIG. 3(*a*) and FIG. 3(*b*) include illustrations of a vane in the compressing element. FIG. 3(*a*) is a plan view of the vane. FIG. 3(*b*) is a front view of the vane. FIG. 4 is a cross-sectional view taken along the line I-I in FIG. 1. FIG. 5 is a view seen from the arrow A in FIGS. 2 and 4. In FIG. 1, the solid-line arrows indicate flows of gas (refrigerant), and the broken-line arrows indicate flows of refrigerating machine oil 25. FIG. 4 illustrates a state where the rotation angle of a rotor portion 4*a* in a rotor shaft 4 is 90 degrees, as described below with FIG. 6. A vane compressor 200 according to Embodiment 1 is described below with reference to FIGS. 1 to 5.

The vane compressor 200 includes a sealing container 103, a compressing element 101, and an electrical element 102 for driving the compressing element 101. The compressing element 101 and the electrical element 102 are housed in the sealing container 103. The compressing element 101 is arranged in the lower portion of the sealing container 103. The electrical element 102 is arranged in the upper portion of the sealing container 103 (more specifically, above the compressing element 101). An oil sump 104 for storing the refrigerating machine oil 25 is disposed on the bottom portion inside the sealing container 103. A suction pipe 26 is attached to the side surface of the sealing container 103. A discharge pipe 24 is attached to the upper surface of the sealing container 103.

The electrical element 102 for driving the compressing element 101 can include, for example, a brushless DC motor. The electrical element 102 includes a stator 21 fixed on the inner periphery of the sealing container 103 and a rotor 22 arranged inside the stator 21. A permanent magnet is used in the rotor 22. When a power is supplied to the coil in the stator 21 through a glass terminal 23 fixed to the sealing container 103 by, for example, welding, a magnetic field occurs in the stator 21, a driving force is provided to the permanent magnet in the rotor 22 by the magnetic field, and the rotor 22 rotates.

The compressing element 101 sucks a low-pressure gas refrigerant through the suction pipe 26 into a compression chamber, compresses the refrigerant, and discharges the compressed refrigerant into the sealing container 103. The refrigerant discharged into the sealing container 103 passes through the electrical element 102 and is discharged to the outside (a high-pressure side in a refrigeration cycle) through the discharge pipe 24 fixed (welded) to the upper portion of the sealing container 103. The compressing element 101 includes the components described below. As the vane compressor 200 according to Embodiment 1, a vane compressor including two vanes (first vane section 5, second vane section 6) is illustrated.

(1) Cylinder 1: Its whole shape is substantially cylindrical, and its opposite ends in the central axial direction are open. That is, the cylinder 1 includes a cylindrical inner surface that defines a hole having opposite openings. A part of the cylinder inner circumferential surface 1*b* (the above-described inner surface defining the hole), which is substantially cylindrical, has a notch 1*c* extending therethrough in the central axial direction and recessed outward (convex toward the outer periphery). A suction port 1*a* extending between the outer circumferential surface and the cylinder inner circumferential surface 1*b* is open to the notch 1*c*. A first discharge port 1*d* is disposed at a location opposite to the suction port 1*a* with respect to a closest point 32, which is described below. The first discharge port 1*d* is in the vicinity of the closest point 32 (illustrated in FIG. 4) and is disposed on a side that faces a frame 2, which is described below (see FIGS. 2 and 4).

A second discharge port 1*e* extending through the cylinder 1 in a radial direction is disposed in the cylinder inner circumferential surface 1*b* at a location farther from the closest point 32 than the first discharge port 1*d*. That is, the second discharge port 1*e* is disposed at a location having a phase angle smaller than that at the first discharge port 1*d* (in other words, at a location upstream of the first discharge port 1*d* in the direction of rotation of the vanes and upstream in the compression stroke). The exit section of the second discharge port 1*e* is largely recessed to shorten the length of the second discharge port 1*e* in the radial direction. That notch portion is surrounded by the frame 2, a cylinder head 3, which are described below, and the sealing container 103 and is defined as a discharge space 41 (illustrated in FIG. 4). In Embodiment 1, the second discharge port 1*e* is configured as two refrigerant channels disposed along the axial direction (that is, disposed at locations having substantially the same phase angles). The cross-sectional shape of each of the refrigerant channels (that is, shape of its opening portion near the cylinder inner circumferential surface 1*b*) is elongated. The width of the second discharge port 1*e* in the circumferential direction is smaller than the width of the tip of each of a vane 5*a* in the first vane section 5 and a vane 6*a* in the second vane section 6, which are described below. A second discharge valve 44 and a second discharge valve guard 45 for regulating the opening degree of the second discharge valve 44 are attached to the exit section of the second discharge port 1*e*. Oil return holes if axially extending through the cylinder 1 are disposed in the outer circumferential portion of the cylinder 1.

(2) Frame 2: It is the one in which a cylindrical member is disposed on the upper portion of a substantially disk-shaped member, and its longitudinal section has a substantially T shape. The substantially disk-shaped member blocks (covers) one opening (upper one in FIG. 2) of the hole in the cylinder 1. An end face of the substantially disk-shaped member near the cylinder 1 (lower surface in FIG. 2) has a recess 2*a*. The recess 2*a* is concentric with the cylinder inner circumferential surface 1*b* in the cylinder 1 and has a cylindrical blind hole shape. The recess 2*a* receives a vane aligner 5*c* in the first vane section 5 and a vane aligner 6*c* in the second vane section 6, which are described below, therein. The vane aligners 5*c* and 6*c* are movably supported (supported such that they can freely rotate and slide) by a vane aligner bearing section 2*b*. The vane aligner bearing section 2*b* is the outer circumferential surface of the recess 2*a*. The frame 2 has a through hole that extends through the substantially cylindrical member from the end face of the substantially disk-shaped member near the cylinder 1. That through hole is provided with a main bearing section 2*c*. The main bearing section 2*c* supports a rotating shaft portion 4*b* in the rotor shaft 4, which is described below such that the rotating shaft portion 4*b* can move. The frame 2 includes a first discharge port 2*d* communicating with the first discharge port 1*d*. A first discharge valve 42 (illustrated in only FIG. 2) covering an opening portion of the first discharge port 2*d* and a first discharge valve guard 43 (illustrated in only FIG. 2) for regulating the opening degree of the first discharge valve 42 are attached to the surface of the substantially disk-shaped member opposite the cylinder 1. The frame 2 further includes a communication path 2*e* axially extending therethrough and communicating with the discharge space 41.

The recess 2*a* may be any one that has an outer circumferential surface (vane aligner bearing section 2*b*) concentric with the cylinder inner circumferential surface 1*b* and is not limited to a cylindrical blind hole shape. For example, the recess 2*a* may be a ring-shaped groove that has an outer circumferential surface (vane aligner bearing section 2*b*) concentric with the cylinder inner circumferential surface 1*b*.

(3) Cylinder head 3: It is the one in which a cylindrical member is disposed on the lower portion of a substantially disk-shaped member, and its longitudinal section has a substantially T shape. The substantially disk-shaped member blocks (covers) another opening (lower one in FIG. 2) in the hole of the cylinder 1. An end face of the substantially disk-shaped member near the cylinder 1 (upper surface in FIG. 2) has a recess 3*a*. The recess 3*a* is concentric with the cylinder inner circumferential surface 1*b* in the cylinder 1 and has a cylindrical blind hole shape. The recess 3*a* receives a vane aligner 5*d* in the first vane section 5 and a vane aligner 6*d* in the second vane section 6, which are described below, therein. The vane aligners 5*d* and 6*d* are movably supported by a vane aligner bearing section 3*b*. The vane aligner bearing section 3*b* is the outer circumferential surface of the recess 3*a*. The cylinder head 3 has a through hole that extends through the substantially cylindrical member from the end face of the substantially disk-shaped member near the cylinder 1. That through hole is provided with a main bearing section 3*c*. The main bearing section 3*c* supports a rotating shaft portion 4*c* in the rotor shaft 4, which is described below, while allowing the rotating shaft portion 4*c* to move.

The recess 3*a* may be any one that has an outer circumferential surface (vane aligner bearing section 2*b*) concentric with the cylinder inner circumferential surface 1*b* and is not limited to a cylindrical blind hole shape. For example, the recess 3*a* may be a ring-shaped groove that has an outer circumferential surface (vane aligner bearing section 2*b*) concentric with the cylinder inner circumferential surface 1*b*.

(4) Rotor shaft 4: It includes the rotor portion 4*a*, the rotating shaft portion 4*b*, and the rotating shaft portion 4*c*. The rotor portion 4*a* is substantially cylindrical and can rotate about the central axis eccentric (offset) to the central axis of the cylinder 1 (more specifically, cylinder inner circumferential surface 1*b*) inside the cylinder 1. The rotating shaft portion 4*b* is concentric with the rotor portion 4*a* and is disposed on the upper portion of the rotor portion 4*a*. The rotating shaft portion 4*c* is concentric with the rotor portion 4*a* and is disposed on the lower portion of the rotor portion 4*a*. The rotor portion 4*a*, the rotating shaft portion 4*b*, and the rotating shaft portion 4*c* are a single-piece construction. As described above, the rotating shaft portions 4*b* and 4*c* are movably supported by the main bearing sections 2*c* and 3*c*, respectively. The rotor portion 4*a* has a plurality of axially extending through holes (bush holding sections 4*d*, 4*e* and vane relief sections 4*f*, 4*g*) each having a substantially cylindrical shape (having a substantially circular cross section). Of those through holes, the bush holding section 4*d* and the vane relief section 4*f* communicate with each other in their side portions, whereas the bush holding section 4*e* and the vane relief section 4*g* communicate with each other in their side portions. The side portion of each of the bush holding sections 4*d* and 4*e* is open to the outer circumferential portion of the rotor portion 4*a*. The axial-direction ends of each of the vane relief sections 4*f* and 4*g* communicate with the recess 2*a* in the frame 2 and the recess 3*a* in the cylinder head 3, respectively. The bush holding sections 4*d* and 4*e* are substantially symmetric with respect to the rotating shaft of the rotor portion 4*a*, and the vane relief sections 4*f* and 4*g* are substantially symmetric with respect to the rotating shaft of the rotor portion 4*a* (see FIG. 4).

An oil pump 31 (illustrated in only FIG. 1) is disposed on the lower end of the rotor shaft 4. One example of the oil pump 31 is described in Japanese Unexamined Patent Application Publication No. 2009-264175. The oil pump 31 sucks the refrigerating machine oil 25 in the oil sump 104 using a centrifugal force of the rotor shaft 4. The oil pump 31 communicates with an axially extending oil supply path 4*h* disposed in an axial central portion of the rotor shaft 4. An oil supply path 4*i* is disposed between the oil supply path 4*h* and the recess 2*a*. An oil supply path 4*j* is disposed between the oil supply path 4*h* and the recess 3*a*. A waste oil hole 4*k* (illustrated in only FIG. 1) is disposed in the rotating shaft portion 4*b* at a location above the main bearing section 3*c*.

(5) First vane section 5: It includes the vane 5*a*, the vane aligner 5*c*, and the vane aligner 5*d*, which are integral with one another. The vane 5*a* is a flat member having a substantially rectangular shape in side view. A vane tip 5*b* near the cylinder inner circumferential surface 1*b* in the cylinder 1 (tip on a side that projects from the rotor portion 4*a*) has an arc shape that is outwardly convex in plan view. The radius of the arc shape of the vane tip 5*b* is substantially equal to the radius of the cylinder inner circumferential surface 1*b* in the cylinder 1. The vane aligner 5*c* supporting the vane 5*a* and having a partial ring shape (shape of a part of a ring, arc shape) is disposed on the upper surface (surface that faces the frame 2) of the vane 5*a* in the vicinity of the end of the vane 5*a* opposite the vane tip 5*b* (hereinafter referred to as inner-side end). Similarly, the vane aligner 5*d* supporting the vane 5*a* and having a partial ring shape is disposed on the lower surface (surface that faces the cylinder head 3) of the vane 5*a* in the vicinity of the inner-side end of the vane 5*a*. The vane 5*a*, the vane aligner 5*c*, and the vane aligner 5*d* are disposed such that the longitudinal direction of the vane 5*a* and the direction of a line normal of the arc of the vane tip 5*b* pass through the center of the arc-shaped portion forming the vane aligners 5*c* and 5*d*.

(6) Second vane section 6: It includes the vane 6*a*, the vane aligner 6*c*, and the vane aligner 6*d*, which are integral with one another. The vane 6*a* is a flat member having a substantially rectangular shape in side view. A vane tip 6*b* near the cylinder inner circumferential surface 1*b* in the cylinder 1 (tip on a side that projects from the rotor portion 4*a*) has an arc shape that is outwardly convex in plan view. The radius of the arc shape of the vane tip 6*b* is substantially equal to the radius of the cylinder inner circumferential surface 1*b* in the cylinder 1. The vane aligner 6*c* supporting the vane 5*a* and having a partial ring shape is disposed on the upper surface (surface that faces the frame 2) of the vane 6*a* in the vicinity of the inner-side end of the vane 6*a*. Similarly, the vane aligner 6*d* supporting the vane 5*a* and having a partial ring shape is disposed on the lower surface (surface that faces the cylinder head 3) of the vane 6*a* in the vicinity of the inner-side end of the vane 6*a*. The vane 6*a*, the vane aligner 6*c*, and the vane aligner 6*d* are disposed such that the longitudinal direction of the vane 6*a* and the direction of a line normal of the arc of the vane tip 6*b* pass through the center of the arc-shaped portion forming the vane aligners 6*c* and 6*d*.

(7) Bushes 7, 8: Each is configured as a pair of substantially semicylindrical members. The bushes 7 sandwiching the vane 5*a* in the first vane section 5 are rotatably placed in the bush holding section 4*d* in the rotor portion 4*a*. The bushes 8 sandwiching the vane 6*a* are rotatably placed in the bush holding section 4*e* in the rotor portion 4*a*. That is, the first vane section 5 can move (slide) in a substantially centrifugal direction with respect to the rotor portion 4*a* (in a centrifugal direction with respect to the center of the cylinder inner circumferential surface 1*b* in the cylinder 1) by sliding movement of the vane 5*a* in the first vane section 5 between the bushes 7. The first vane section 5 can swing (rotate) by rotation of the bushes 7 inside the bush holding section 4*d* in the rotor portion 4*a*. Similarly, the second vane section 6 can move (slide) in a substantially centrifugal direction with respect to the rotor portion 4*a* by sliding movement of the vane 6*a* in the second vane section 6 between the bushes 8. The second vane section 6 can swing (rotate) by rotation of the bushes 8 inside the bush holding section 4*e* in the rotor portion 4*a*. Bush centers 7*a* and 8*a* illustrated in FIG. 4 indicate the center of rotation of the bushes 7 and that of the bushes 8, respectively.

The vane aligners 5*c*, 5*d*, 6*c*, and 6*d*, the vane aligner bearing sections 2*b* and 3*b* in the recesses 2*a* and 3*a*, the bush holding sections 4*d* and 4*e*, and the bushes 7 and 8 correspond to vane angle adjusting means in the present invention.

(Explanation of Operations)

Operations of the vane compressor 200 according to Embodiment 1 are described below.

As illustrated in FIG. 4, the rotor portion 4*a* in the rotor shaft 4 and the cylinder inner circumferential surface 1*b* in the cylinder 1 are closest to each other at one place (closest point 32 illustrated in FIG. 4).

When the radius of each of the vane aligner bearing sections 2*b* and 3*b* is $r_a$ (see FIG. 7 described below) and the radius of the cylinder inner circumferential surface 1*b* is $r_c$ (see FIG. 4), the distance $r_v$ (see FIG. 3) between the outer circumferential surface side of each of the vane aligners 5*c* and 5*d* in the first vane section 5 and the vane tip 5*b* is set as in Expression (1) given below.

$$r_v = r_c - r_a - \delta \quad (1)$$

δ is the gap between the vane tip 5*b* and the cylinder inner circumferential surface 1*b*. Setting $r_v$ as in Expression (1) enables the first vane section 5 to rotate without coming into contact with the cylinder inner circumferential surface 1*b*. To minimize the leakage of a refrigerant from the vane tip 5*b*, $r_v$ is set so as to minimize δ. The relationship in Expression (1) can also apply to the second vane section 6. The second vane section 6 can rotate while the gap between the vane tip 6*b* in the second vane section 6 and the cylinder inner circumferential surface 1*b* is maintained at a short distance.

By maintaining each of the gap between the first vane section 5 and the cylinder inner circumferential surface 1*b* and the gap between the second vane section 6 and the cylinder inner circumferential surface 1*b* at a short distance, as described above, three spaces (suction chamber 9, intermediate chamber 10, compression chamber 11) are formed (illustrated in FIG. 4). The suction port 1*a*, which communicates with the low-pressure side of the refrigeration cycle, is open to the suction chamber 9 through the notch 1*c*. In FIG. 4 (rotation angle of 90 degrees), the notch 1*c* is disposed in the area from the vicinity of the closest point 32 to the point B, at which the vane tip 5*b* in the first vane section 5 and the cylinder inner circumferential surface 1*b* are opposed to each other.

First, a rotation operation of the vane compressor 200 according to Embodiment 1 is described.

When the rotating shaft portion 4*b* in the rotor shaft 4 receives rotation power from the electrical element 102 being the driving section, the rotor portion 4*a* rotates inside the cylinder 1. With the rotation of the rotor portion 4*a*, the bush holding sections 4*d* and 4*e*, which are arranged in the vicinity of the outer periphery of the rotor portion 4*a*, rotate about the rotor shaft 4 as the rotation axis (central axis) and move along the circumference of a circle. The pairs of bushes 7 and 8, which are held in the bush holding sections 4*d* and 4*e*, respectively, and the vane 5*a* in the first vane section 5 and the vane 6*a* in the second vane section 6, which are held between the pair of bushes 7 and between the pair of bushes 8, respectively, such that the vanes 5*a* and 6*a* can freely slide, rotate with the rotor portion 4*a*.

The first vane section 5 and the second vane section 6 receive centrifugal force caused by the rotation, and the vane aligners 5*c* and 6*c* and the vane aligners 5*d* and 6*d* slide while being pressed against the vane aligner bearing sections 2*b* and 3*b*, respectively. While sliding, the vane aligners 5*c* and 6*c* and the vane aligners 5*d* and 6*d* rotate about the central axes of the vane aligner bearing sections 2*b* and 3*b*, respectively. As described above, the vane aligner bearing sections 2*b* and 3*b* are concentric with the cylinder inner circumferential surface 1*b*. Thus the first vane section 5 and the second vane section 6 rotate about the center of the cylinder inner circumferential surface 1*b*. Then the bushes 7 and 8 rotate about the bush centers 7*a* and 8*a* inside the bush holding sections 4*d* and 4*e*, respectively, such that the longitudinal direction of each of the vane 5*a* in the first vane section 5 and the vane 6*a* in the second vane section 6 is directed to the center of the cylinder.

In the above-described operation, with the rotation, the sides of the bushes 7 and the vane 5*a* in the first vane section 5 slide with each other, and the sides of the bushes 8 and the vane 6*a* in the second vane section 6 slide with each other. The bush holding section 4*d* in the rotor shaft 4 and the bushes 7 slide with each other, and the bush holding section 4*e* and the bushes 8 slide with each other.

Figure 6:
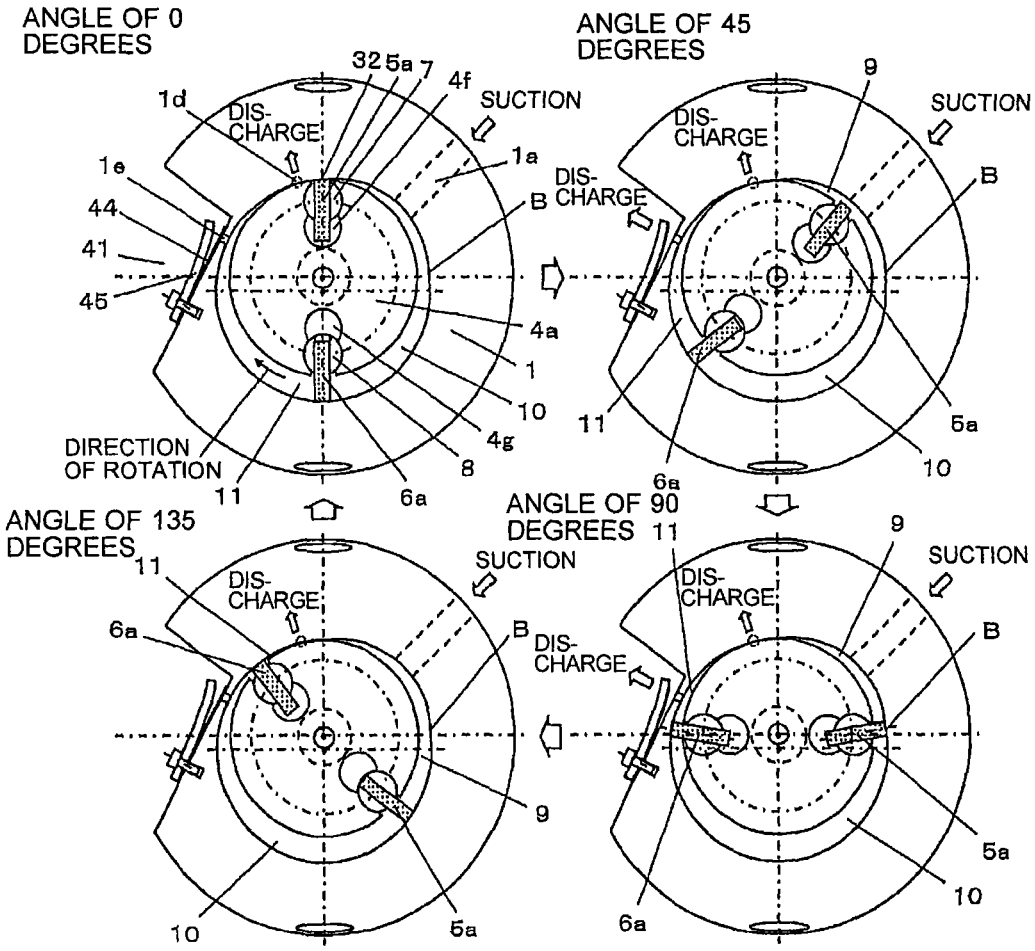
FIG. 6 includes illustrations for describing a compressing operation by the compressing element according to Embodiment 1 of the present invention and illustrates cross-sectional views taken along the line I-I in FIG. 1.

FIG. 6 includes illustrations for describing a compressing operation by the compressing element according to Embodiment 1 of the present invention. FIG. 6 illustrates cross-sectional views taken along the line I-I in FIG. 1. How the volume of each of the suction chamber 9, the intermediate chamber 10, and the compression chamber 11 varies with rotation of the rotor portion 4*a* (rotor shaft 4) is described below with reference to FIG. 6. First, with rotation of the rotor shaft 4, a low-pressure refrigerant flows into the suction port 1*a* through the suction pipe 26. To describe variations in the volume of each space (suction chamber 9, intermediate chamber 10, compression chamber 11), the rotation angle of the rotor portion 4*a* (rotor shaft 4) is defined as described below. First, a state in which the place where the first vane section 5 and the cylinder inner circumferential surface 1*b* in the cylinder 1 slide with each other (contact place) coincides with the closest point 32 is defined as "angle of 0 degrees." FIG. 6 illustrates positions of the first vane section 5 and the second vane section 6 and states of the suction chamber 9, the intermediate chamber 10, and the compression chamber 11 in the states at "angle of 0 degrees," "angle of 45 degrees," "angle of 90 degrees," and "angle of 135 degrees."

The solid arrow in the illustration for "angle of 0 degrees" in FIG. 6 indicates the direction of rotation of the rotor shaft 4 (clockwise direction in FIG. 6). The arrow indicating the direction of rotation of the rotor shaft 4 is omitted in the other illustrations. The states at "angle 180 degrees" and thereafter are not illustrated in FIG. 6 because the state of "angle 180 degrees" is the same as the state where the first vane section 5 and the second vane section 6 at "angle of 0 degrees" are interchanged with each other, and the subsequent operation is the same as the compressing operation from "angle of 0 degrees" to "angle of 135 degrees."

At "angle of 0 degrees" in FIG. 6, the right space between the closest point 32 and the second vane section 6 is the intermediate chamber 10. The intermediate chamber 10 communicates with the suction port 1*a* through the notch 1*c* and sucks gas (refrigerant). The left space between the closest point 32 and the second vane section 6 is the compression chamber 11 communicating with the first discharge port 1*d* and the second discharge port 1*e*.

At "angle of 45 degrees" in FIG. 6, the space between the first vane section 5 and the closest point 32 is the suction chamber 9 communicating with the suction port 1*a* through the notch 1*c*. The space between the first vane section 5 and the second vane section 6 is the intermediate chamber 10. In that state, the suction chamber 9 and the intermediate chamber 10 communicate with the suction port 1*a* through the notch 1*c*. Because the volume of the intermediate chamber 10 is larger than that at "angle of 0 degrees," the sucking of the gas continues. The space between the second vane section 6 and the closest point 32 is the compression chamber 11. The volume of the compression chamber 11 is smaller than that at "angle of 0 degrees," and the refrigerant is compressed, and its pressure gradually increases.

When the pressure in the compression chamber 11 exceeds the high pressure in the refrigeration cycle, the first discharge valve 42 and the second discharge valve 44 are opened, the gas in the compression chamber 11 is discharged into the sealing container 103 from the first discharge port 1*d* through the first discharge port 2*d* and is also discharged into the sealing container 103 from the second discharge port 1*e* through the discharge space 41 and the communication path 2*e*. The gas discharged in the sealing container 103 passes by the electrical element 102 and is discharged to the outside (high-pressure side in the refrigeration cycle) from the discharge pipe 24, which is fixed (welded) to the upper portion of the sealing container 103 (indicated by the solid lines in FIG. 1). Accordingly, the pressure in the sealing container 103 is discharge pressure, which is high pressure. In FIG. 6, the state at "angle of 45 degrees" illustrates the case where the pressure in the compression chamber 11 exceeds the high pressure in the refrigeration cycle.

At "angle of 90 degrees" in FIG. 6, the vane tip 5*b* in the first vane section 5 coincides with the point B on the cylinder inner circumferential surface 1*b* in the cylinder 1, and thus the intermediate chamber 10 does not communicate with the suction port 1*a*. Upon this, the sucking of the gas in the intermediate chamber 10 ends. In that state, the volume of the intermediate chamber 10 is substantially the largest. The volume of the suction chamber 9 is larger than that at "angle of 45 degrees," and the sucking continues. The volume of the compression chamber 11 is further smaller than that at "angle of 45 degrees," and the gas in the compression chamber 11 is discharged into the sealing container 103 from the first discharge port 1*d* through the first discharge port 2*d* and is also discharged into the sealing container 103 from the second discharge port 1*e* through the discharge space 41 and the communication path 2*e*.

At "angle of 135 degrees" in FIG. 6, the volume of the intermediate chamber 10 is smaller than that at "angle of 90 degrees," and the pressure of the gas increases. The volume of the suction chamber 9 is larger than that at "angle of 90 degrees," and the sucking continues. At that time, the vane 6*a* in the second vane section 6 has passed by the second discharge port 1*e*, the second discharge port 1*e* is open to the intermediate chamber 10, and thus the second discharge valve 44 is closed by differential pressure. In contrast, the first discharge port 1*d* remains open to the compression chamber 11, and thus the first discharge valve 42 is open. The volume of the compression chamber 11 is further smaller than that at "angle of 90 degrees," the gas in the compression chamber 11 is discharged into the sealing container 103 from the first discharge port 1*d* through the first discharge port 2*d*.

After that, when the second vane section 6 has passed by the first discharge port 1*d*, a high-pressure refrigerant slightly remains in the compression chamber 11 (leads to losses). At "angle 180 degrees" (not illustrated), when the compression chamber 11 becomes nonexistent, that high-pressure refrigerant changes into a low-pressure refrigerant in the suction chamber 9. At "angle 180 degrees," the suction chamber 9 shifts to the intermediate chamber 10, the intermediate chamber 10 shifts to the compression chamber 11, and after that, the compressing operation is repeated.

In such a way, the rotation of the rotor portion 4*a* (rotor shaft 4) causes the volume of the suction chamber 9 to gradually increase, and the sucking of the gas continues. Then the suction chamber 9 shifts to the intermediate chamber 10. Up to one point, the volume gradually increases, and the sucking of the gas continues. At that point, the volume of the intermediate chamber 10 is the largest, the intermediate chamber 10 does not communicate with the suction port 1*a*, and the sucking of the gas ends. After that point, the volume of the intermediate chamber 10 gradually decreases, and the gas is compressed. After that, the intermediate chamber 10 shifts to the compression chamber 11, and the compressing of the gas continues. The gas compressed to a predetermined pressure passes through the first discharge ports 1*d* and 2*d*, pushes the first discharge valve 42, and is discharged into the sealing container 103. The gas compressed to the predetermined pressure also passes through the second discharge port 1*e*, pushes the second discharge valve 44, passes through discharge space 41 and the communication path 2*e*, and is discharged into the sealing container 103. After that, when the vane 6*a* in the second vane section 6 has passed by the second discharge port 1*e*, the second discharge valve 44 is closed, and the compressed gas in the compression chamber 11 is discharged into the sealing container 103 only from the first discharge port 1*d* and the first discharge port 2*d*.

Figure 7:
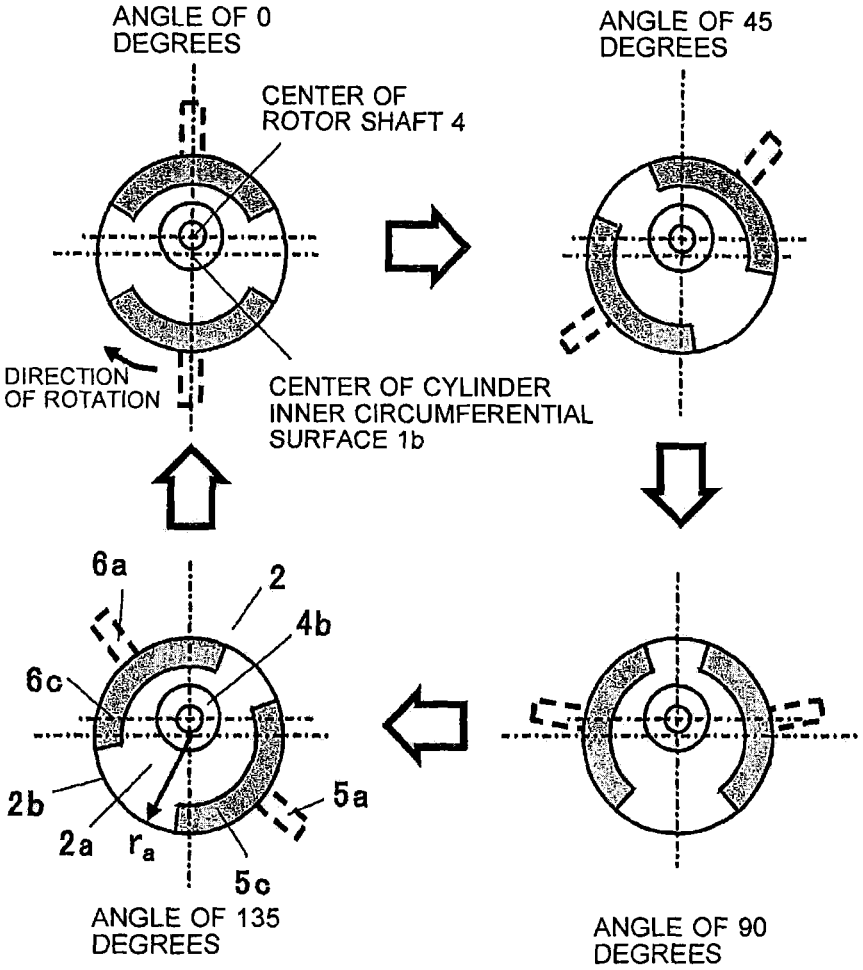
FIG. 7 includes illustrations for describing a rotating operation of vane aligners according to Embodiment 1 of the present invention and illustrates cross-sectional views taken along the line II-II in FIG. 1.

FIG. 7 includes illustrations for describing a rotating operation of the vane aligners according to Embodiment 1 of the present invention. FIG. 7 illustrates cross-sectional views taken along the line II-II in FIG. 1. FIG. 7 illustrates the rotating operation of the vane aligners 5*c* and 6*c*. The arrow in the illustration for "angle of 0 degrees" in FIG. 7 indicates the direction of rotation of the vane aligners 5*c* and 6*c* (clockwise direction in FIG. 7). The arrow indicating the direction of rotation of the vane aligners 5*c* and 6*c* is omitted in the other illustrations.

With rotation of the rotor shaft 4, the vane 5*a* in the first vane section 5 and the vane 6*a* in the second vane section 6 rotate about the central axis of the cylinder 1 (see FIG. 6). With this, as illustrated in FIG. 7, the vane aligners 5*c* and 6*c* are supported by the vane aligner bearing section 2*b* and rotate about the central axis of the cylinder inner circumferential surface 1*b* inside the recess 2*a*. That operation is the same as for the vane aligners 5*d* and 6*d*, which are supported by the vane aligner bearing section 2*b* and rotate inside the recess 3*a*.

Rotation of the rotor shaft 4 in the above-described refrigerant compressing operation causes the refrigerating machine oil 25 to be sucked up from the oil sump 104 by the oil pump 31, as indicated by the broken-line arrows in FIG. 1, and the refrigerating machine oil 25 is sent to the oil supply path 4*h*. The refrigerating machine oil 25 sent to the oil supply path 4*h* is sent to the recess 2*a* in the frame 2 through the oil supply path 4*i* and is sent to the recess 3*a* in the cylinder head 3 through the oil supply path 4*j*.

The refrigerating machine oil 25 sent to the recesses 2*a* and 3*a* lubricates the vane aligner bearing sections 2*b* and 3*b*, and part of the refrigerating machine oil 25 is supplied to the vane relief sections 4*f* and 4*g*, which communicate with the recesses 2*a* and 3*a*. Because the pressure in the sealing container 103 is discharge pressure, which is high pressure, the pressure in each of the recesses 2*a* and 3*a* and the vane relief sections 4*f* and 4*g* is also the discharge pressure. Part of the refrigerating machine oil 25 sent to the recesses 2*a* and 3*a* is supplied to the main bearing section 2*c* in the frame 2 and the main bearing section 3*c* in the cylinder head 3.

The refrigerating machine oil 25 sent to the vane relief sections 4*f* and 4*g* flows as described below.

Figure 8:
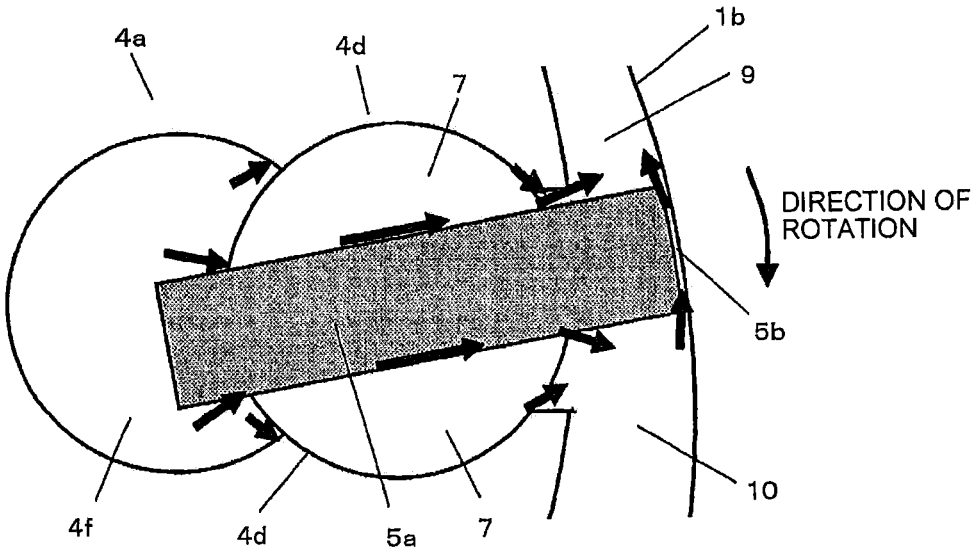
FIG. 8 is an enlarged view that illustrates the vane in a vane section and its vicinity according to Embodiment 1 of the present invention.

FIG. 8 is an enlarged view that illustrates the vane in the vane section and its vicinity according to Embodiment 1 of the present invention. FIG. 8 is an enlarged view that illustrates the vane 5*a* in the first vane section 5 and its vicinity in FIG. 4. The solid-line arrows in FIG. 8 indicate flows of the refrigerating machine oil 25.

As previously described, the pressure in the vane relief section 4*f* is the discharge pressure and is higher than the pressure in each of the suction chamber 9 and the intermediate chamber 10. Thus the refrigerating machine oil 25 is sent into the suction chamber 9 and the intermediate chamber 10 by differential pressure and centrifugal force while lubricating the sliding section between the side of the vane 5*a* and the bushes 7. The refrigerating machine oil 25 is sent into the suction chamber 9 and the intermediate chamber 10 by differential pressure and centrifugal force while lubricating the sliding section between the bushes 7 and the bush holding section 4*d* in the rotor shaft 4. Part of the refrigerating machine oil 25 sent to the intermediate chamber 10 flows into the suction chamber 9 while sealing the gap between the vane tip 5*b* and the cylinder inner circumferential surface 1*b* in the cylinder 1.

FIG. 8 illustrates the case where the spaces partitioned by the first vane section 5 are the suction chamber 9 and the intermediate chamber 10. The same behavior appears in the case where the rotation advances and the spaces partitioned by the first vane section 5 are the intermediate chamber 10 and the compression chamber 11. When the pressure in the compression chamber 11 reaches the discharge pressure, which is the same as the pressure in the vane relief section 4*f*, the refrigerating machine oil 25 is also sent toward the compression chamber 11 by centrifugal force. The above-described operation is described for the first vane section 5. The same operation is performed for the second vane section 6.

In the above-described oil supplying operation, as illustrated in FIG. 1, the refrigerating machine oil 25 supplied to the main bearing section 2*c* passes through the gap in the main bearing section 2*c* and is discharged into the space above the frame 2. After that, the refrigerating machine oil 25 is returned to the oil sump 104 through the oil return holes if in the outer circumferential portion in the cylinder 1. The refrigerating machine oil 25 supplied to the main bearing section 3*c* passes through the gap in the main bearing section 3*c* and is returned to the oil sump 104. The refrigerating machine oil 25 sent to the suction chamber 9, the intermediate chamber 10, and the compression chamber 11 through the vane relief sections 4*f* and 4*g* is also finally discharged into the space above the frame 2 from the first discharge port 2*d* and the communication path 2*e* together with the gas and then returned to the oil sump 104 through the oil return holes 1*f* in the outer circumferential portion in the cylinder 1. A surplus of the refrigerating machine oil 25 sent to the oil supply path 4*h* by the oil pump 31 is discharged from the waste oil hole 4*k* in the upper portion of the rotor shaft 4 into the space above the frame 2 and then is returned to the oil sump 104 through the oil return holes 1*f* in the outer circumferential portion in the cylinder 1.

The above-described operations are performed in Embodiment 1. To facilitate the understanding of the advantageous effects of the vane compressor 200 according to Embodiment 1, an operation of discharging gas from the compression chamber 11 is described below in comparison with a typical vane compressor that includes only the first discharge port 1*d* as a discharge port (for example, a vane compressor described in Patent Literature 1).

First, the operation of discharging gas from the compression chamber 11 in a typical vane compressor that includes only the first discharge port 1*d* as a discharge port (hereinafter, a publicly known vane compressor having the configuration different from Embodiment 1 is referred to simply as a typical vane compressor) is described below with reference to FIG. 6. FIG. 6 demonstrates that the flow width (length in the radial direction) of the compression chamber 11 at the location of the first discharge port 1*d* is significantly narrow, and the flow area is also very small. Accordingly, the flow velocity of the gas in the compression chamber 11 increases before the gas flows into the first discharge port 1*d*, and the pressure loss increases, regardless of the size of the first discharge port 1*d*.

In contrast, in the vane compressor 200 according to Embodiment 1, the second discharge port 1*e* is disposed at a location having a phase angle smaller than that at the first discharge port 1*d*. Thus the flow width (flow area) in the compression chamber 11 at the location of the second discharge port 1*e* is large. Thus the flow velocity of the gas in the compression chamber 11 before the gas flows into the second discharge port 1*e* is low, and the pressure loss can be reduced. When the second vane section 6 has passed by the second discharge port 1*e*, as illustrated in the illustration for "angle of 135 degrees" in FIG. 6, only the first discharge port 1*d* is open to the compression chamber 11. However, at that point in time, the quantity of flow of the gas discharged from the compression chamber 11 has considerably decreased, the flow velocity of the gas in the compression chamber 11 flowing into the first discharge port 1*d* is not high, and the pressure loss is small.

The above-described arrangement in which the second discharge port 1*e* is disposed at a location having a phase angle smaller than that at the first discharge port 1*d* enables the discharge loss to be smaller than that in a typical vane compressor.

Below is the description of gas behavior while the second vane section 6 is passing by the second discharge port 1*e* in the operation of discharging gas from the compression chamber 11.

Figure 9:
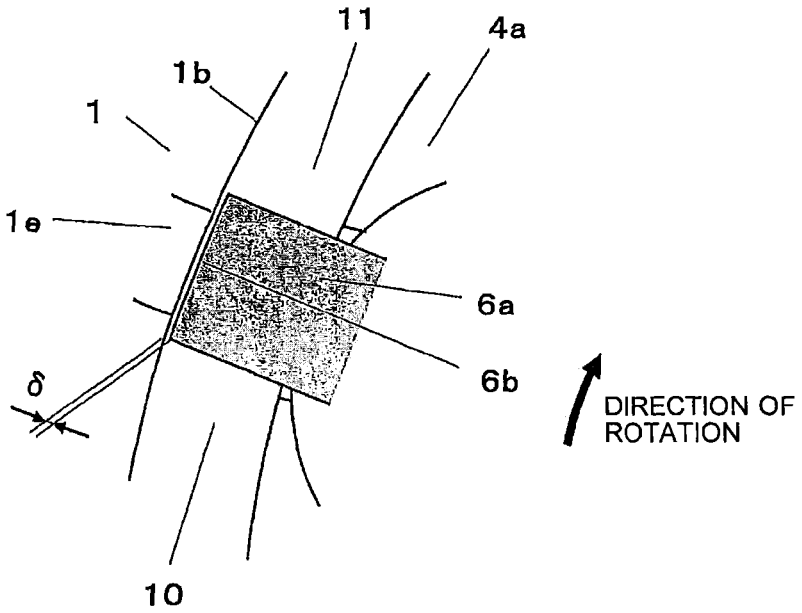
FIG. 9(*a*) and FIG. 9(*b*) include illustrations for describing gas behavior while the vane is passing by a second discharge port.
Figure 9:
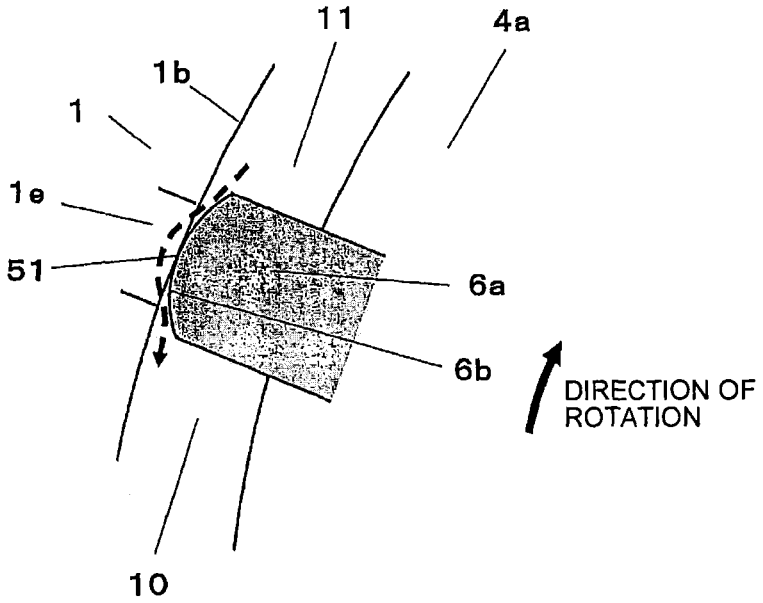

FIG. 9(*a*) and FIG. 9(*b*) include illustrations for describing gas behavior while the vane is passing by the second discharge port. FIG. 9(*a*) and FIG. 9(*b*) illustrate cross-sectional views of the vane 6*a* in the second vane section 6 and its vicinity when the vane tip 6*b* in the second vane section 6 is at the location of the second discharge port 1*e*. More specifically, FIG. 9(*a*) illustrates the case where the vane tip 6*b* has the shape illustrated in Embodiment 1 (the radius of the arc shape of the vane tip 6*b* is substantially equal to the radius of the cylinder inner circumferential surface 1*b*). FIG. 9(*b*) illustrates the case where the vane tip 6*b* has the shape in a typical vane compressor (for example, one in which the vane can freely slide in the vane groove in the rotor portion, as described in Patent Literature 1 or Patent Literature 2).

As illustrated in FIG. 9(*a*), in the vane compressor 200 according to Embodiment 1, the radius of the arc shape of the vane tip 6*b* in the second vane section 6 is substantially equal to the radius of the cylinder inner circumferential surface 1*b*. Thus the gap between the vane tip 6*b* in the second vane section 6 and the cylinder inner circumferential surface 1*b* is a minute gap δ over the width of the vane tip 6*b* (see Expression (1)). In contrast, the width of the second discharge port 1*e* (more specifically, the opening portion open to the cylinder inner circumferential surface 1*b*) in the circumferential direction is smaller than that of the vane tip 6*b* in the second vane section 6. Thus when the second vane section 6 has passed by the second discharge port 1*e*, the gap between the vane tip 6*b* and the cylinder inner circumferential surface 1*b* remains at δ. Accordingly, the amount of gas leaking from the compression chamber 11 to the intermediate chamber 10 through the gap between the vane tip 6*b* and the cylinder inner circumferential surface 1*b* can be significantly reduced.

In contrast, as illustrated in FIG. 9(*b*), when the vane tip 6*b* has the shape in a typical vane compressor, the radius of the arc shape of the vane tip 6*b* in the second vane section 6 is very smaller than that of the cylinder inner circumferential surface 1*b*. Thus the gap between the vane tip 6*b* and the cylinder inner circumferential surface 1*b* increases with an increase in the distance from a contact place 51 between the vane tip 6*b* and the cylinder inner circumferential surface 1*b* (contact place between the vane tip 6*b* and the location of the cylinder inner circumferential surface 1*b* where the second discharge port 1*e* is not disposed in the axial direction). Thus even when the width of the second discharge port 1*e* (more specifically, the opening portion open to the cylinder inner circumferential surface 1*b*) in the circumferential direction is smaller than the width of the vane tip 6*b* in the second vane section 6, there exists a leakage path from the compression chamber 11 to the intermediate chamber 10 through the second discharge port 1*e*, as indicated by the broken line in FIG. 9(*b*). Accordingly, the amount of gas leaking from the compression chamber 11 to the intermediate chamber 10 through the gap between the vane tip 6*b* and the cylinder inner circumferential surface 1*b* is increased.

The reason why there is a difference in the amount of gas leaking from the compression chamber 11 to the intermediate chamber 10 through the gap between the vane tip 6*b* and the cylinder inner circumferential surface 1*b* is described below. That is, in the case of a typical vane compressor described in Patent Literature 1 or Patent Literature 2, it is necessary that the radius of the arc shape forming the vane tip 6*b* (and 5*b*) be smaller than the radius of the cylinder inner circumferential surface 1*b*. This is because in a typical vane compressor described in Patent Literature 1 or Patent Literature 2, the center of the rotor portion 4*a* and the center of the cylinder inner circumferential surface 1*b* are displaced from each other, the vane rotates about the center of the rotor portion 44*a* as the rotation axis. That is, to enable the arc-shaped portion of the vane tip 6*b* (and 5*b*) and the cylinder inner circumferential surface 1*b* to continuously slide, it is necessary to have a smaller radius of the arc shape of the vane tip 6*b* (and 5*b*) than the radius of the cylinder inner circumferential surface 1*b*. In contrast, in the vane compressor 200 according to Embodiment 1, because the first vane section 5 and the second vane section 6 are configured to rotate about the center of the cylinder inner circumferential surface 1*b* as the rotation axis (in other words, because the compressing operation can be performed while the line normal to the arc shape of each of the vane tips 5*b* and 6*b* and the line normal to the cylinder inner circumferential surface 1*b* continuously coincide with each other), the radius of the arc shape of the vane tip 6*b* (and 5*b*) and the radius of the cylinder inner circumferential surface 1*b* can be set at an equal value or approximately equal values.

Consequently, in the vane compressor 200 according to Embodiment 1, the pressure loss can be reduced without an increase in leakage of gas while the first vane section 5 and the second vane section 6 are passing by the second discharge port 1*e*. Thus the highly efficient vane compressor 200 with significantly small losses is obtainable.

In Embodiment 1, the width of the second discharge port 1*e* (more specifically, the opening portion open to the cylinder inner circumferential surface 1*b*) in the circumferential direction is smaller than the width of each of the vane tip 5*b* in the first vane section 5 and the vane tip 6*b* in the second vane section 6. The width of the second discharge port 1*e* (more specifically, the opening portion open to the cylinder inner circumferential surface 1*b*) in the circumferential direction can be increased to a value equal to the width of the vane tip 5*b* in the first vane section 5 and the vane tip 6*b* in the second vane section 6.

In Embodiment 1, the relationship between the cross-sectional area of the first discharge port 1*d* and the cross-sectional area of the second discharge port 1*e* is not particularly mentioned. One example relationship therebetween is described below. That is, because the flow area in the compression chamber 11 at the location of the second discharge port 1*e* is larger than that at the location of the first discharge port 1*d*, in order to effectively reduce the pressure loss, it is preferable that the quantity of flow discharged from the second discharge port 1*e* be maximized. To this end, it is preferable that the cross-sectional area of the second discharge port 1*e* be larger than the cross-sectional area of the first discharge port 1*d*.

In Embodiment 1, the second discharge port 1*e* is configured as two refrigerant channels. That is merely one example. The second discharge port 1*e* is not limited to the above-described configuration.

Figure 10:
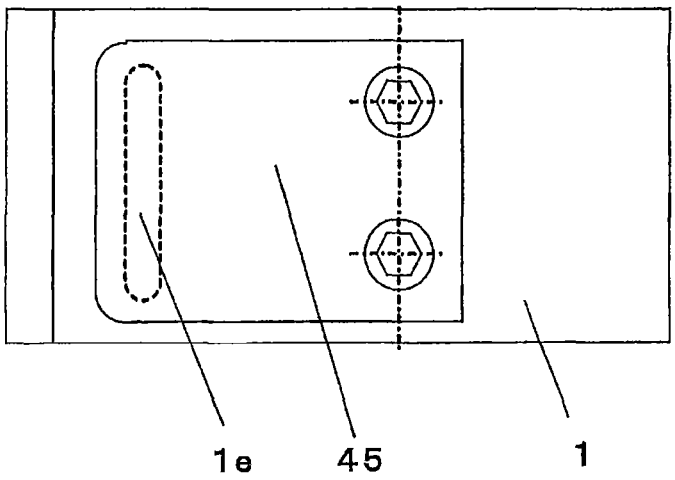
FIG. 10 is an illustration for describing another example of the second discharge port in the vane compressor according to Embodiment 1.

FIG. 10 is an illustration for describing another example of the second discharge port in the vane compressor according to Embodiment 1. FIG. 10 is a view seen from the arrow A in FIGS. 2 and 4.

For example, as illustrated in FIG. 10, the second discharge port 1*e* may be configured as one refrigerant channel. The second discharge port 1*e* may also be configured as three or more refrigerant channels. The cross-sectional shape of the second discharge port 1*e* (if the second discharge port 1*e* is configured as a plurality of refrigerant channels, the cross-sectional shape of each of the refrigerant channels) is also not limited to an elongated shape. That cross-sectional shape may be any one in which its width in the circumferential direction is equal to or smaller than the width of each of the vane tip 5*b* in the first vane section 5 and the vane tip 6*b* in the second vane section 6.

The destination of gas flowing from the compression chamber 11 into the second discharge port is not limited to the above-described configuration. For example, the second discharge port 1*e* may not extend through the outer circumferential side of the cylinder 1, at least one of the frame 2 and the cylinder head 3 may have a through hole communicating with the second discharge port 1*e*, and gas flowing from the compression chamber 11 into the second discharge port may flow into the sealing container 103 from that through hole. In that case, the second discharge valve 44 and the second discharge valve guard 45 may be disposed on the exit section of that through hole. With such a configuration, substantially the same advantageous effects as in the above description are obtainable from substantially the same operations as in the above description.

The first discharge port is also not limited to the above-described configuration.

Figure 11:
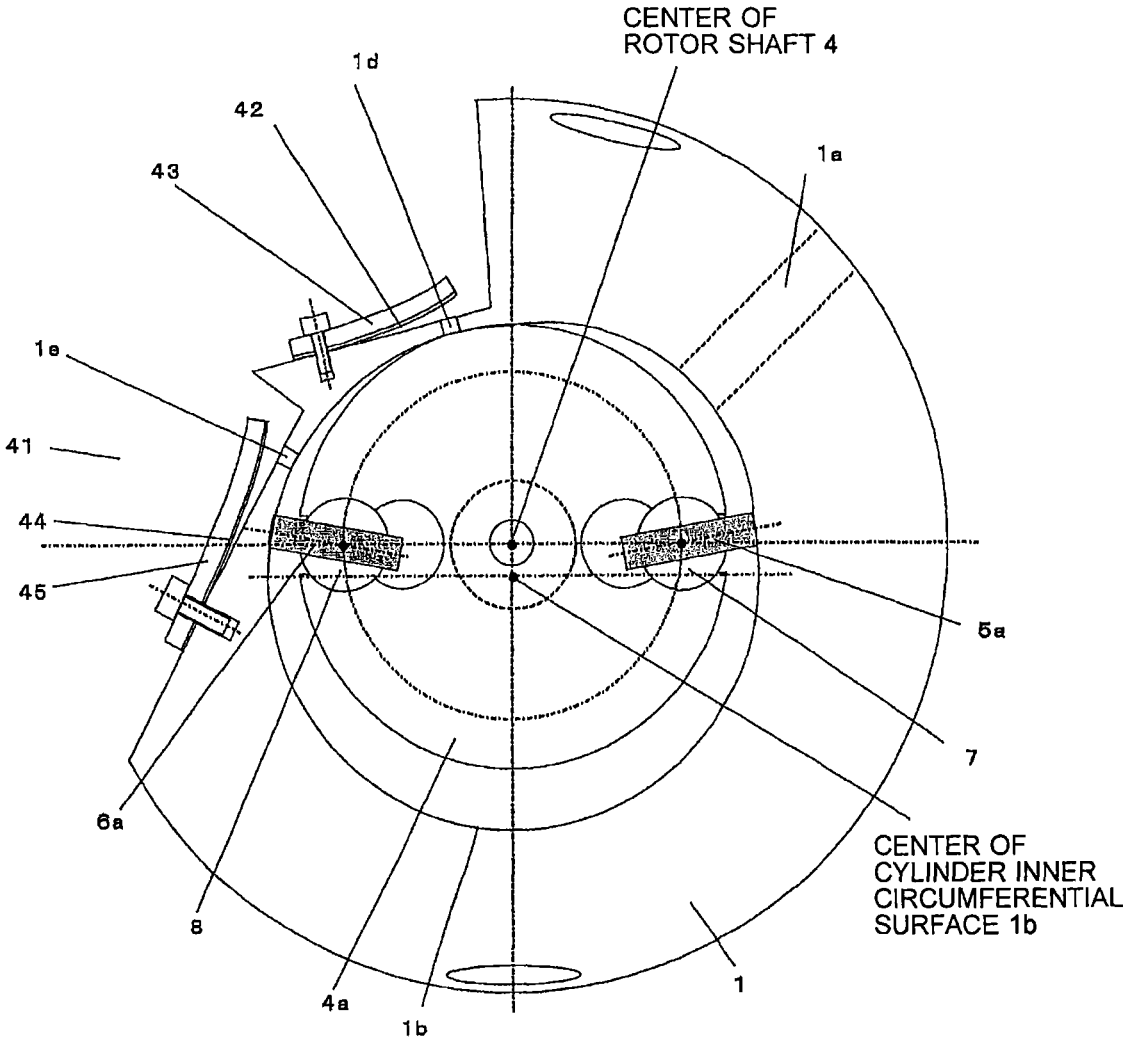
FIG. 11 is an illustration for describing another example of a first discharge port in the vane compressor according to Embodiment 1.

FIG. 11 is an illustration for describing another example of the first discharge port in the vane compressor according to Embodiment 1. FIG. 11 is a cross-sectional view taken along the line I-I in FIG. 1 and illustrates a state corresponding to the illustration for the rotation angle of 90 degrees in FIG. 6.

In FIG. 11, the first discharge port 1*d* extends through the cylinder inner circumferential surface 1*b* in the radial direction, as in the case of the second discharge port 1*e*. Thus the first discharge valve 42 and the first discharge valve guard 43 are attached on the exit section of the first discharge port 1*d*. With such a configuration, substantially the same advantageous effects as in the above description are obtainable from substantially the same operations as in the above description.

For example, in the above-described first vane section 5 and second vane section 6, the longitudinal direction of the vane 5*a* and that of the vane 6*a* are substantially the same as the direction of a line normal to the arc of the vane tip 5*b* and that of the vane tip 6*b*, respectively. Other configurations may be used. One example of the other configurations of the first vane section 5 and the second vane section 6 is illustrated in FIG. 12.

Figure 12:
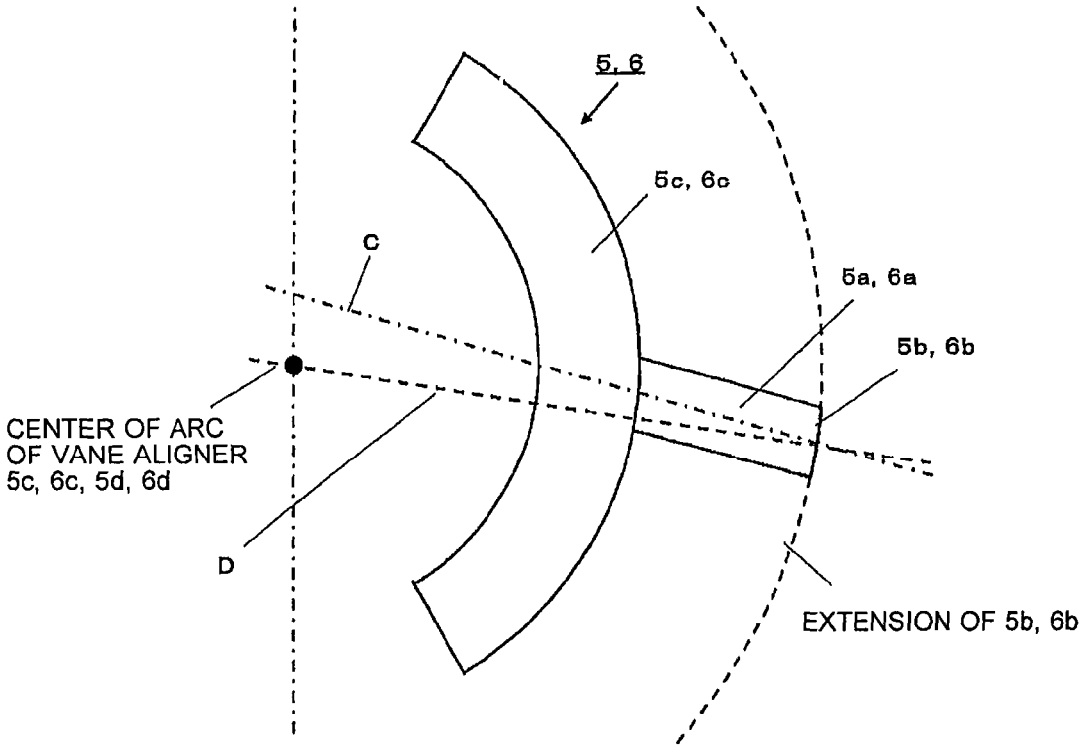
FIG. 12 is a plan view that illustrates yet another example of the vane in the compressing element according to Embodiment 1 of the present invention.
Figure 13:
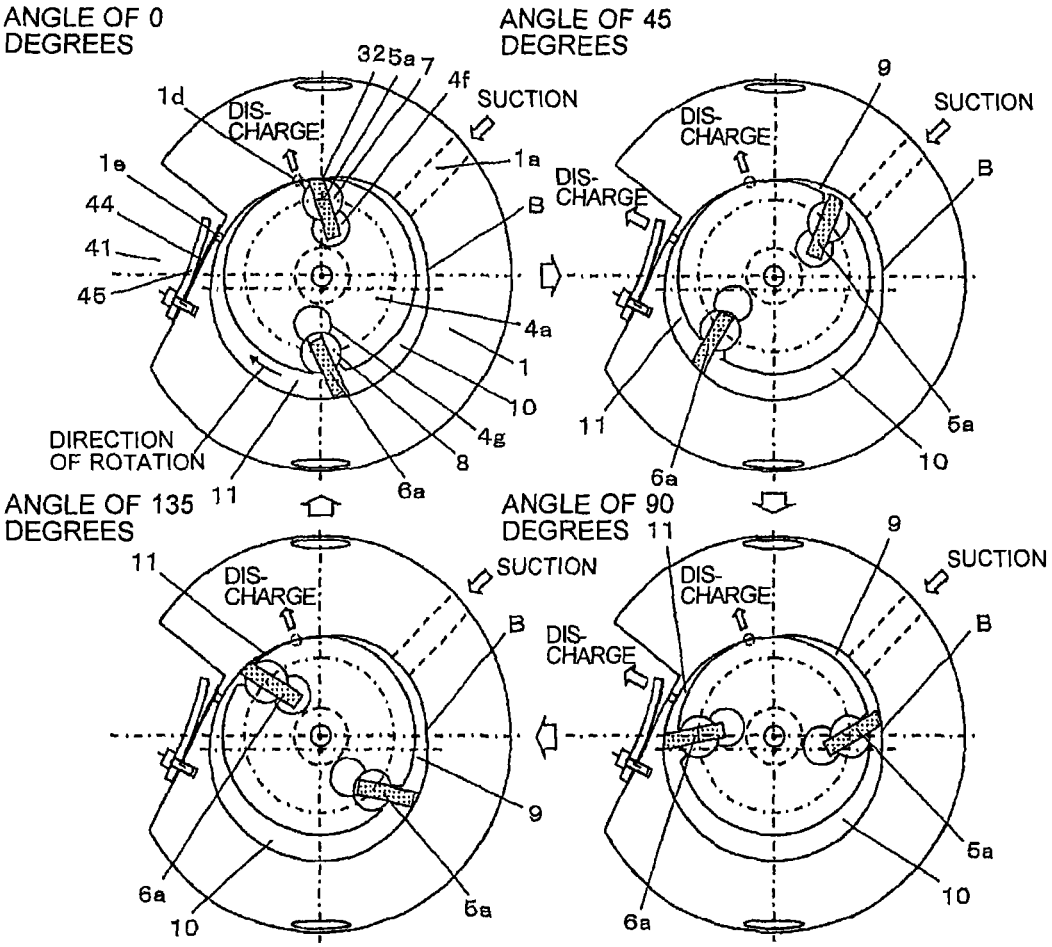
FIG. 13 includes illustrations (cross-sectional views) for describing a compressing operation by the compressing element illustrated in FIG. 12.

FIG. 12 is a plan view that illustrates yet another example of the vane in the compressing element according to Embodiment 1 of the present invention.

In FIG. 12, C indicates the longitudinal direction of each of the vanes 5*a* and 6*a*, and D indicates the direction of a line normal to the arc of each of the vane tips 5*b* and 6*b*. That is, the vane 5*a* and the vane 6*a* are inclined in the direction of C with respect to the vane aligners 5*c* and 5*d* and the vane aligners 6*c* and 6*d*, respectively. The line normal D to the arc of the vane tip 5*b* and that of the vane tip 6*b* are inclined with respect to the vane longitudinal direction C and pass through the center of the arc-shaped portion forming the vane aligners 5*c* and 5*d* and that forming the vane aligners 6*c* and 6*d*, respectively.

With the configuration illustrated in FIG. 12, the compressing operation can be performed in a state where the line normal to the arc of each of the vane tips 5*b* and 6*b* and the line normal to the cylinder inner circumferential surface 1*b* in the cylinder 1 are continuously the same during rotation. Accordingly, substantially the same advantageous effects as in the above description are obtainable. The length of the arc of each of the vane tips 5*b* and 6*b* (that is, the width of each of the vane tips 5*b* and 6*b*) can be long, and the advantageous effect of being able to have a larger cross-sectional area of the second discharge port 1*e* and a longer width of the opening portion in the second discharge port 1*e* to the compression chamber 11 in the circumferential direction is also obtainable.

Embodiment 2

In Embodiment 1, the vane compressor 200 including one discharge port (second discharge port 1*e*) at a location having a phase angle smaller than that at the first discharge port 1*d* is described. A plurality of second discharge ports may be disposed at locations having phase angles smaller than that at the first discharge port 1*d*. In Embodiment 2, items that are not particularly described are substantially the same as in Embodiment 1, and the same functions and configurations are described using the same reference numerals.

Figure 14:
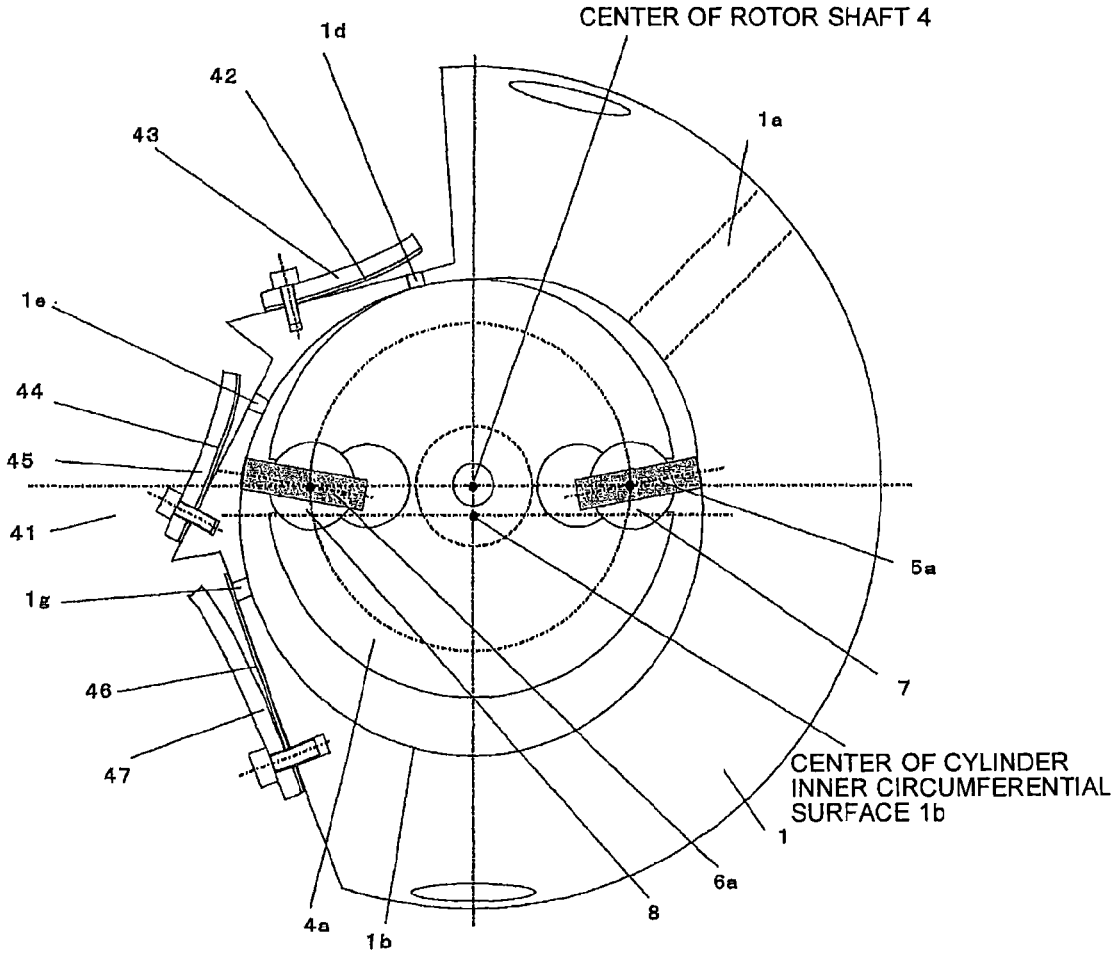
FIG. 14 is a cross-sectional view that illustrates a compressing element in a vane compressor according to Embodiment 2.

FIG. 14 is a cross-sectional view that illustrates a compressing element in a vane compressor according to Embodiment 2, FIG. 14 is a cross-sectional view taken along the line I-I in FIG. 1 and illustrates a state corresponding to the illustration for the rotation angle of 90 degrees in FIG. 6.

As illustrated in FIG. 14, the vane compressor 200 according to Embodiment 2 includes two second discharge ports (second discharge port 1*e*, second discharge port 1*g*). That is, the vane compressor 200 according to Embodiment 2 is the one in which the second discharge port 1*g* is added to the configuration of the vane compressor 200 illustrated in Embodiment 1. The second discharge port 1*g* extends through the cylinder 1 in a radial direction and is disposed at a location having a phase angle smaller than that at the second discharge port 1*e*, and the width of the second discharge port 1*g* in the circumferential direction is smaller than the width of each of the vane tip 5*b* in the first vane section 5 and the vane tip 6*b* in the second vane section 6. A third discharge valve 46 and a third discharge valve guard 47 for regulating the opening degree of the third discharge valve 46 are attached to the exit section of the second discharge port 1*g*. In Embodiment 2, because the second discharge port 1*g* is disposed at the location having the phase angle smaller than that at the second discharge port 1*e*, the flow width (flow area) of the compression chamber 11 at the location of the second discharge port 1*g* is further larger than that at the location of the second discharge port 1*e*.

Figure 15:
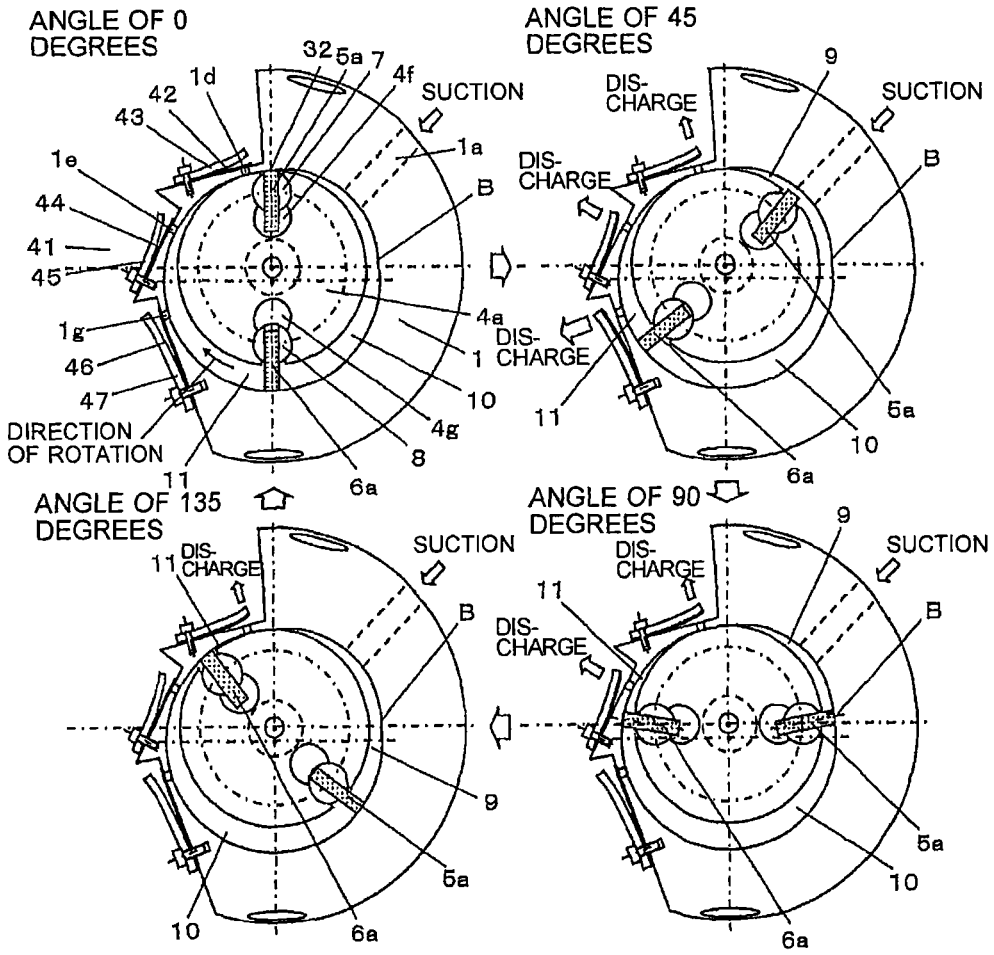
FIG. 15 includes illustrations for describing a compressing operation by the compressing element according to Embodiment 2 of the present invention and illustrates cross-sectional views taken along the line I-I in FIG. 1.

FIG. 15 includes illustrations for describing a compressing operation by the compressing element according to Embodiment 2 of the present invention and illustrates cross-sectional views taken along the line I-I in FIG. 1. An operation of discharging gas from the compression chamber 11 is described below with reference to FIG. 15.

At "angle of 45 degrees" in FIG. 15, when the pressure in the compression chamber 11 exceeds the high pressure in the refrigeration cycle, the first discharge valve 42, the second discharge valve 44, and the third discharge valve 46 are opened. The gas in the compression chamber 11 flows into the discharge space 41 from the first discharge port 1*d*, the second discharge port 1*e*, and the second discharge port 1*g*, and it is discharged into the sealing container 103 through the communication path 2*e*. In FIG. 15, the state at "angle of 45 degrees" illustrates the case where the pressure in the compression chamber 11 exceeds the high pressure in the refrigeration cycle.

At "angle of 90 degrees" in FIG. 15, the second vane section 6 has passed by the second discharge port 1*g*, and the second discharge port 1*g* is open to the intermediate chamber 10. Thus the third discharge valve 46 is closed by differential pressure. The first discharge port 1*d* and the second discharge port 1*e* are open to the compression chamber 11, and the gas in the compression chamber 11 is discharged from the first discharge port 1*d* and the second discharge port 1*e*.

At "angle of 135 degrees" in FIG. 15, the second vane section 6 has passed by the second discharge port 1*e*, and the second discharge port 1*e* is open to the intermediate chamber 10. Thus the second discharge valve 44 is closed by differential pressure. The first discharge port 1*d* is open to the compression chamber 11, and the gas in the compression chamber 11 is discharged from the first discharge port 1*d*.

Consequently, in the vane compressor 200 configured as in Embodiment 2, because the flow area in the compression chamber 11 at the location of the second discharge port 1*g* is larger than that at the location of the second discharge port 1*e*, the flow velocity of the gas in the compression chamber 11 before it flows into the second discharge port 1*g* is lower than that in Embodiment 1. Thus the pressure loss can be further reduced. When the second vane section 6 has passed by the second discharge port 1*g*, as illustrated in the illustration for "angle of 90 degrees" in FIG. 15, the first discharge port 1*d* and the second discharge port 1*e* are open to the compression chamber 11. At that point in time, because the quantity of gas discharged from the compression chamber 11 has decreased to some extent, the flow velocity of the gas in the compression chamber 11 flowing into the second discharge port 1*e* can be lower than that in Embodiment 1, and the pressure loss can be further reduced.

In Embodiment 2, the cross-sectional area of each of the first discharge port 1*d*, the second discharge port 1*e*, and the second discharge port 1*g* is not particularly mentioned. One example of that cross-sectional area is described below. That is, the flow area in the compression chamber 11 at the location of the second discharge port 1*g* is larger than that at the location of the second discharge port 1*e*, and the flow area in the compression chamber 11 at the location of the second discharge port 1*e* is larger than that at the location of the first discharge port 1*d*. To effectively reduce the pressure loss, it is preferable that the cross-sectional area of the first discharge port 1*d* be the smallest, that of the second discharge port 1*e* be the second smallest, and that of the second discharge port 1*g* be the largest. That is, to effectively reduce the pressure loss, it is preferable that the cross-sectional areas of the discharge ports increase with a decrease in the phase angle.

In Embodiment 2, the vane compressor 200 including the two second discharge ports (the second discharge port 1*e*, the second discharge port 1*g*) with different phase angles is described. The vane compressor may also include three or more second discharge ports with different phase angles. In that case, to effectively reduce the pressure loss, it is preferable that the cross-sectional areas of the discharge ports increase with a decrease in the phase angle.

Embodiment 3

In Embodiments 1 and 2, the opening portion in the second discharge port to the compression chamber 11 is open to the cylinder inner circumferential surface 1*b*. The opening portion in the second discharge port to the compression chamber 11 may be open to a location described below. In Embodiment 3, items that are not particularly described are substantially the same as in Embodiment 1 or 2, and the same functions and configurations are described using the same reference numerals.

Figure 16:
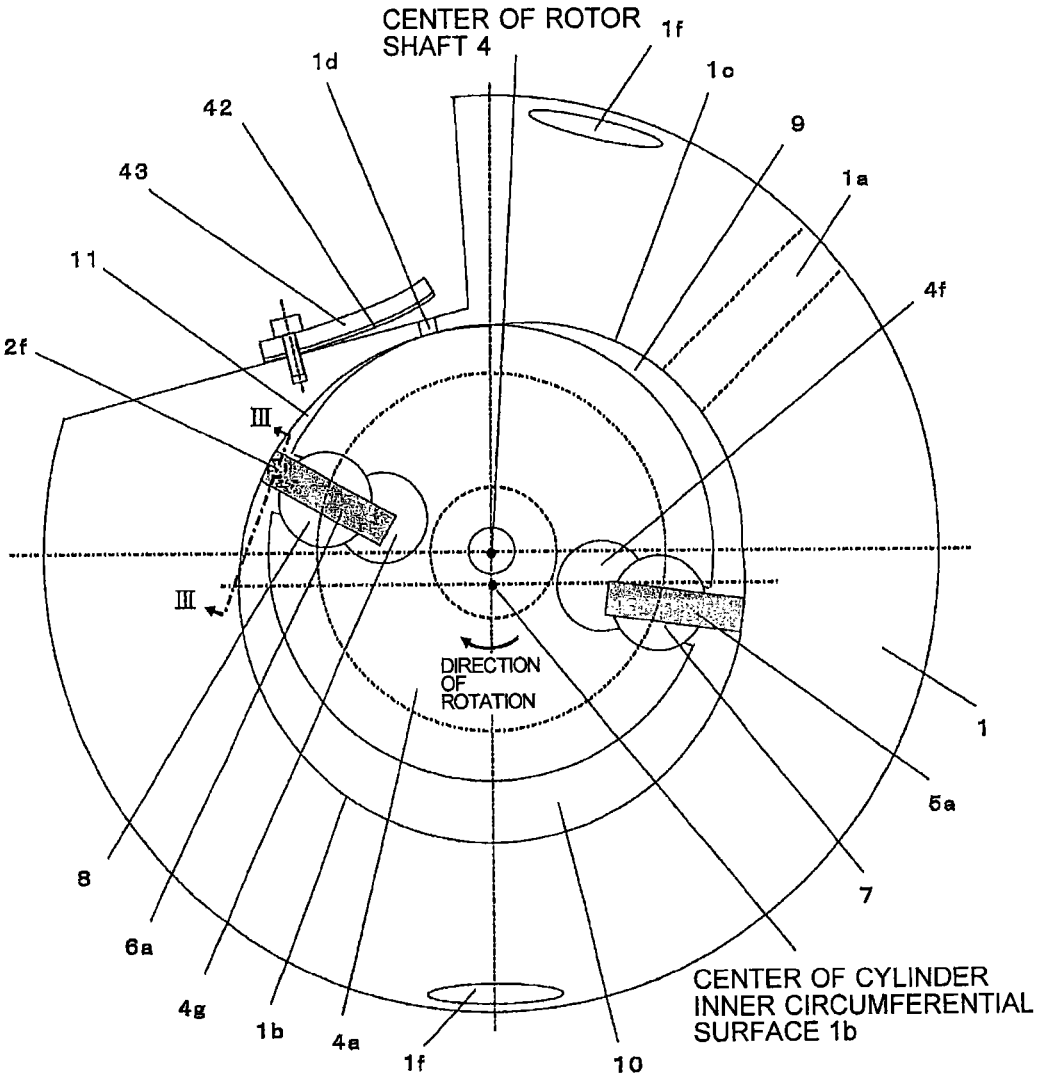
FIG. 16 is a cross-sectional view that illustrates a compressing element in a vane compressor according to Embodiment 3.
Figure 17:
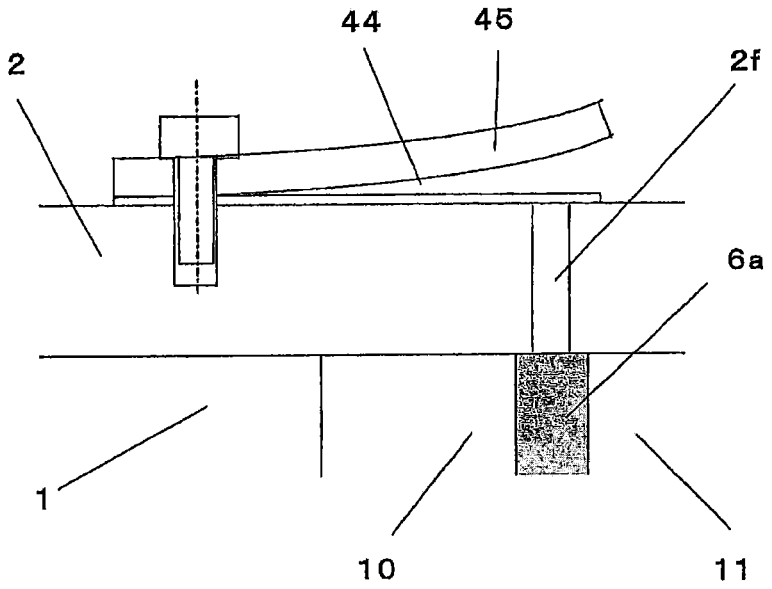
FIG. 17 is a cross-sectional view taken along the line in FIG. 16.

FIG. 16 is a cross-sectional view that illustrates a compressing element in a vane compressor according to Embodiment 3. FIG. 16 is a cross-sectional view taken along the line I-I in FIG. 1 and illustrates a state corresponding to the illustration for angle of 90 degrees in FIG. 6. FIG. 17 is a cross-sectional view taken along the line III-III in FIG. 16.

The vane compressor 200 according to Embodiment 3 is described below with reference to FIGS. 16 and 17.

As illustrated in FIGS. 16 and 17, in the vane compressor 200 according to Embodiment 3, the frame 2 includes a second discharge port 2*f* axially extending therethrough. The width of the second discharge port 2*f* in the circumferential direction is smaller than that of each of the vane 5*a* in the first vane section 5 and the vane 6*a* in the second vane section 6. The second discharge valve 44 and the second discharge valve guard 45 are attached to the exit section of the second discharge port 2*f*.

The operation of discharging gas from the compression chamber 11 in the vane compressor 200 according to Embodiment 3 is substantially the same as in Embodiment 1. Gas behavior while the first vane section 5 or the second vane section 6 is passing by the second discharge port 2*f* is described below.

As illustrated in FIG. 17, the width of the second discharge port 2*f* in the circumferential direction is smaller than the width of the vane 6*a*. Thus when the second vane section 6 is at the location of the second discharge port 2*f*, leakage of gas from the compression chamber 11 to the intermediate chamber 10 through the second discharge port 2*f* is sealed with the end face of the vane 6*a* and the end face of the frame 2. Accordingly, the leakage of gas from the compression chamber 11 to the intermediate chamber 10 can be significantly reduced, as in the case of Embodiment 1.

Consequently, in the vane compressor 200 configured as in Embodiment 3, the pressure loss can be reduced without an increase in leakage of gas while the first vane section 5 and the second vane section 6 are passing by the second discharge port 2*f*, as in the case of Embodiments 1 and 2. Thus the highly efficient vane compressor 200 with significantly small losses is obtainable.

In the vane compressor 200 according to Embodiment 3, because the second discharge port 2*f* is disposed in the frame 2 (that is, the opening portion in the second discharge port 2*f* to the compression chamber 11 is open to the frame 2), the following advantageous effect is also obtainable. That is, in Embodiment 1 or 2, where the opening portion in each of one or more second discharge ports (second discharge port 1*e* and second discharge port 1*g*) to the compression chamber 11 is open to the cylinder inner circumferential surface 1*b*, it is necessary to set the radius of the arc shape of each of the vane tips 5*b* and 6*b* and the radius of the cylinder inner circumferential surface 1*b* at substantially equal values. To enable the first vane section 5 and the second vane section 6 to rotate about the center of the cylinder inner circumferential surface 1*b* (in other words, to enables the compressing operation to be performed while the line normal to the arc shape of each of the vane tips 5*b* and 6*b* and the line normal to the cylinder inner circumferential surface 1*b* are continuously substantially the same), vane angle adjusting means is needed. In contrast, in Embodiment 3, as is clear from FIG. 17, because leakage of gas from the compression chamber 11 to the intermediate chamber 10 through the second discharge port 2*f* is sealed with the interface between the frame 2 and the end face of each of the first vane section 5 and the second vane section 6, the vane compressor is also applicable to a typical vane compressor, such as one described in Patent Literature 1.

In Embodiment 3, the second discharge port 2*f* is disposed in the frame 2. The second discharge port 2*f* may be disposed in the cylinder head 3 or may be disposed in each of the frame 2 and the cylinder head 3.

In Embodiment 3, the width of the second discharge port 2*f* (more specifically, the opening portion to the compression chamber 11) in the circumferential direction is smaller than the width of each of the vane 5*a* in the first vane section 5 and the vane 6*a* in the second vane section 6. The width of the second discharge port 2*f* (more specifically, the opening portion to the compression chamber 11) in the circumferential direction can be increased to a value equivalent to the width of each of the vane 5*a* in the first vane section 5 and the vane 6*a* in the second vane section 6.

In Embodiment 3, two second discharge ports may be disposed, and three or more second discharge ports may also be disposed, as in the case of Embodiment 2.

In Embodiments 1 to 3, the case where the number of vanes is two is illustrated. In the cases where the number of vanes is one and where the number of vanes or three or more, substantially the same configuration is used and substantially the same advantageous effects are obtainable. When the number of vanes is one, the vane aligner may have a ring shape, instead of a partial ring shape.

In Embodiments 1 to 3, the oil pump 31 using centrifugal force of the rotor shaft 4 is described. The oil pump may have any form. For example, a positive displacement pump described in Japanese Unexamined Patent Application Publication No. 2009-62820 may be used as the oil pump 31.

The vane angle adjusting means described in Embodiments 1 to 3 is one example and is not limited to the above-described configuration. The present invention can be carried out using publicly known vane angle adjusting means. For example, as in the vane compressor described in Japanese Unexamined Patent Application Publication No. 2000-352390, the configuration may be used in which the rotor portion is hollow, a fixed shaft is arranged in the space of the rotor portion, the fixed shaft supports vanes such that they can rotate about the center of the cylinder inner circumferential surface, and the vanes are held in the vicinity of the outer circumferential portion of the rotor portion through a bush such that the vanes can swing with respect to the rotor portion. With such vane angle adjusting means, because the vanes rotate about the center of the cylinder inner circumferential surface, the radius of the arc shape of each of the vane tips and the radius of the cylinder inner circumferential surface can be set at substantially equal values. Thus substantially the same advantageous effects as in Embodiments 1 and 2 are obtainable from substantially the same operations as in Embodiments 1 and 2.

In Embodiments 2 and 3, all the plurality of second discharge ports are disposed in the same member. The locations where the second discharge ports are disposed are not limited to the above-described example. For example, one or more of the second discharge ports may be configured such that the opening portion(s) to the compression chamber 11 is open to the cylinder inner circumferential surface 1*b* (for example, in the configuration in Embodiment 2), and the remaining one or more of the second discharge ports may be configured such that the opening portion(s) to the compression chamber 11 is open to at least one of the frame 2 and the cylinder head 3.

Figure 18:
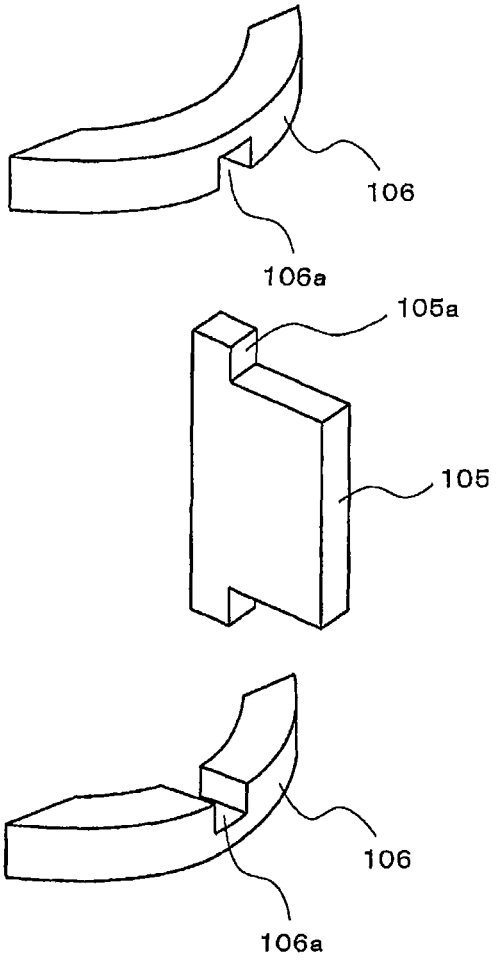
FIG. 18 is a perspective view that illustrates another example of connection of the vane and the vane aligner in the vane compressor according to Embodiments 1 to 3 of the present invention.

In Embodiments 1 to 3, the vane 5*a* and the vane aligners 5*c* and 5*d* are integral with one another, and the vane 6*a* and the vane aligners 6*c* and 6*d* are integral with one another. They may be separate pieces if the longitudinal direction of each of the vanes 5*a* and 6*a* and the line normal to the outer circumferential surface of each of the vane aligners 5*c*, 5*d*, 6*c*, and 6*f* can be maintained at a constant angle. For example, as illustrated in FIG. 18, a vane 105, which corresponds to each of the vanes 5*a* and 6*a*, and vane aligners 106, which correspond to the vane aligners 5*c* and 5*d* and the vane aligners 6*c* and 6*d*, can be separate pieces. A projection 105*a* of the vane 105 may be inserted into a recess 106*a* of each of the vane aligners 106, and the vane 105 and the vane aligners 106 may be attached integrally. At that time, the vane 105 and the vane aligners 106 may be connected such that the vane 105 can freely slide in its longitudinal direction with respect to the vane aligners 106.

REFERENCE SIGNS LIST

1 cylinder, 1*a* suction port, 1*b* cylinder inner circumferential surface, 1*c* notch, 1*d* first discharge port, 1*e* second discharge port, 1*f* oil return hole, 1*g* second discharge port, 2 frame, 2*a* recess, 2*b* vane aligner bearing section, 2*c* main bearing section, 2*d* first discharge port, 2*e* communication path, 2*f* second discharge port, 3 cylinder head, 3*a* recess, 3*b* vane aligner bearing section, 3*c* main bearing section, 4 rotor shaft, 4*a* rotor portion, 4*b* rotating shaft portion, 4*c* rotating shaft portion, 4*d* bush holding section, 4*e* bush holding section, 4*f* vane relief section, 4*g* vane relief section, 4*h* oil supply path, 4*i* oil supply path, 4*j* oil supply path, 4*k* waste oil hole, 5 first vane section, 5*a* vane, 5*b* vane tip, 5*c* vane aligner, 5*d* vane aligner, 6 second vane section, 6*a* vane, 6*b* vane tip, 6*c* vane aligner, 6*d* vane aligner, 7 bushes, 7*a* bush center, 8 bushes, 8*a* bush center, 9 suction chamber, 10 intermediate chamber, 11 compression chamber, 21 stator, 22 rotor, 23 glass terminal, 24 discharge pipe, 25 refrigerating machine oil, 26 suction pipe, 31 oil pump, 32 closest point, 41 discharge space, 42 first discharge valve, 43 first discharge valve guard, 44 second discharge valve, 45 second discharge valve guard, 46 third discharge valve, 47 third discharge valve guard, 51 contact place, 101 compressing element, 102 electrical element, 103 sealing container, 104 oil sump, 105 vane, 105*a* projection, 106 vane aligner, 106*a* recess, 200 vane compressor.

The invention claimed is:

1. A vane compressor comprising:

a cylinder including a cylindrical inner circumferential surface that defines a hole having opposite openings;

a cylinder head that covers one of the openings;

a frame that covers another one of the openings;

a cylindrical rotor portion configured to rotate about a rotation axis displaced from a central axis of the inner circumferential surface inside the cylinder;

a rotating shaft portion configured to transmit a rotational force to the rotor portion; and a vane disposed inside the rotor portion, held rotatably about a center of the cylinder inner circumferential surface of the cylinder, and partitioning a compression space formed between the cylinder and the rotor portion into at least a suction space and a discharge space;

wherein each of the frame and the cylinder head includes a recess or a ring-shaped groove in an end face near the cylinder, the recess or the ring-shaped groove having an outer circumferential surface concentric with the inner circumferential surface of the cylinder, a vane aligner having a partial ring-shape and configured to support the vane is provided, the vane aligner being configured to freely slide and rotate along the outer circumferential surface, and integrally attached to the vane or integrally formed with the vane so as to keep a gap between a tip of the vane and the inner circumferential surface of the cylinder, a first discharge port communicating with the compression space and a second discharge port communicating with the compression space are provided, the first discharge port configured to allow gas compressed in the compression space to be discharged therethrough, the second discharge port being provided at a location upstream from the first discharge port in a compression stroke, the second discharge port includes an opening portion to the compression space, the opening portion having a width equal to or smaller than a width of the vane, and the second discharge port has a cross-sectional area larger than a cross-sectional area of the first discharge port.

2. The vane compressor of claim 1, wherein the second discharge port is open to the inner circumferential surface of the cylinder, and the opening portion in the second discharge port to the compression space has a width in a circumferential direction, the width being equal to or smaller than a width of a tip of the vane.

3. The vane compressor of claim 2, wherein the second discharge port is one of a plurality of second discharge ports disposed at locations having different phase angles.

4. The vane compressor of claim 3, wherein each of the first discharge port and the second discharge ports has a cross-sectional area increasing with a decrease in the phase angle at which each of the first discharge port and the second discharge ports communicates with the compression space.

5. The vane compressor of claim 1, wherein the second discharge port is open to at least one of the frame and the cylinder head, and the opening portion in the second discharge port to the compression space has a width in a circumferential direction, the width being equal to or smaller than a width of the vane.

6. The vane compressor of claim 1, wherein the second discharge port is one of a plurality of second discharge ports disposed at locations having different phase angles and opened to the inner circumferential surface of the cylinder and at least one of the frame and the cylinder head, the opening portion in the second discharge port that is open to the inner circumferential surface of the cylinder has a width in a circumferential direction, the width being equal to or smaller than a width of the tip of the vane, and the opening portion in the second discharge port that is open to the at least one of the frame and the cylinder head has a width in the circumferential direction, the width being equal to or smaller than the width of the vane.

7. The vane compressor of claim 1, wherein the tip of the vane has an outwardly curved arc shape, and the arc shape has a radius equal to a radius of the inner circumferential surface of the cylinder.

8. The vane compressor of claim 1, wherein the vane is supported such that the vane rotates and slides with respect to the rotor portion.

9. The vane compressor of claim 8, wherein the rotor portion includes a cylindrical bush holding section axially extending therethrough, the bush holding section receives a pair of bushes having a semicylindrical shape therein, and the vane is supported such that the vane rotates and slides with respect to the rotor portion by being supported between the bushes.

* * * * *